US007146972B2

(12) United States Patent
Ohkuma

(10) Patent No.: US 7,146,972 B2
(45) Date of Patent: Dec. 12, 2006

(54) EXHAUST GAS SENSOR ACTIVATION JUDGMENT AND AIR FUEL RATIO CONTROL SYSTEM/METHOD

(75) Inventor: Shigeo Ohkuma, Gunma (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/227,916

(22) Filed: Sep. 16, 2005

(65) Prior Publication Data

US 2006/0070607 A1 Apr. 6, 2006

(30) Foreign Application Priority Data

Sep. 17, 2004 (JP) ..... 2004-271866
Aug. 22, 2005 (JP) ..... 2005-240112

(51) Int. Cl.
*F02D 41/14* (2006.01)

(52) U.S. Cl. ..... 123/676; 123/685; 123/688; 73/23.32; 701/109

(58) Field of Classification Search ..... 123/676, 123/685, 688; 73/23.32; 701/109
See application file for complete search history.

(56) References Cited

U.S. PATENT DOCUMENTS 3,895,611 A * 7/1975 Endo et al. ..... 123/694
4,155,335 A * 5/1979 Hosaka et al. ..... 123/676
4,363,306 A * 12/1982 Sone et al. ..... 123/676
4,392,470 A * 7/1983 Gunther et al. ..... 123/688
4,970,858 A * 11/1990 Matsuoka ..... 123/688
5,036,470 A * 7/1991 Suzuki et al. ..... 701/109
5,070,692 A * 12/1991 Nada ..... 60/274
5,615,661 A * 4/1997 Suzuki ..... 123/688
2003/0154053 A1* 8/2003 Saga ..... 702/185
2003/0213692 A1 11/2003 Sakai et al.

FOREIGN PATENT DOCUMENTS

JP 58-193454 11/1983

* cited by examiner

*Primary Examiner*—Erick R Solis
(74) *Attorney, Agent, or Firm*—Sughrue Mion, PLLC

(57) ABSTRACT

An air fuel ratio control system includes an exhaust gas sensor to sense an oxygen concentration in an exhaust passage of an internal combustion engine, and a controller. The controller is configured to judge that the exhaust gas sensor is in an active state, by monitoring a decrease of an output of the exhaust gas sensor from a level greater than a first predetermined value, to a level smaller than or equal to the predetermined first predetermined value, and to allow the air fuel ratio control when the exhaust gas sensor is judged to be in the active state.

14 Claims, 16 Drawing Sheets

EXHAUST GAS SENSOR ACTIVATION JUDGMENT AND AIR FUEL RATIO CONTROL SYSTEM/METHOD

BACKGROUND OF THE INVENTION

The present invention relates to apparatus and/or process for controlling an air fuel ratio for an internal combustion engine in accordance with an oxygen content sensed by an exhaust gas sensor disposed in an exhaust passage of an internal combustion engine, and to apparatus and/or process for detecting activation of an exhaust gas sensor.

A published Japanese patent application No. S58(1983)-193454 (≈DE 33 05 699 A1) shows an oxygen sensor which can be used as an exhaust gas sensor for an air fuel ratio control system for an internal combustion engine. This sensor is of a quasi reference electrode type which does not use the atmospheric air at a standard electrode. An oxygen sensor of this type includes a solid electrolyte film sandwiched between anode and cathode and an electric circuit for applying a bias voltage between the anode and cathode. The oxygen content is sensed by measuring a potential difference between both electrodes in the state in which the bias voltage is applied and an oxygen partial pressure is controlled between both electrodes.

SUMMARY OF THE INVENTION

When, however, the solid electrolyte film is in a non-active state and the impedance of the solid electrolyte film is high as in a cold start engine operation, for example, the application of the bias voltage produces a potential difference between the anode and cathode, and thereby tends to cause an erroneous judgment that the air fuel ratio is rich with respect to the stoichiometry, so that the rich/lean judgment of the air fuel ratio can be distorted.

Therefore, it is an object of the present invention to provide air fuel ratio control system, apparatus and/or process for improving the accuracy of the rich/lean judgment and the accuracy of the air fuel ratio control. It is another object of the present invention to provide exhaust gas sensor activation judging system, apparatus and/or process for detecting the activation of an exhaust gas sensor accurately.

According to one aspect of the present invention, an air fuel ratio control system comprises: an exhaust gas sensor disposed in an exhaust passage of an internal combustion engine and arranged to sense an oxygen concentration; an actuator arranged to perform an air fuel ratio control in accordance with the oxygen concentration sensed by the exhaust gas sensor; and a controller configured to judge that the exhaust gas sensor is in an active state, by monitoring a decrease of an output of the exhaust gas sensor from a level greater than a first predetermined value, to a level smaller than or equal to the predetermined first predetermined value, and to allow the air fuel ratio control when the exhaust gas sensor is judged to be in the active state.

According to another aspect of the invention, an air fuel ratio control process comprises: a first process element of performing an air fuel ratio control for an internal combustion engine in accordance with a sensed oxygen concentration of an exhaust of an internal combustion engine; a second process element of examining whether the exhaust gas sensor is in an active state or not, by monitoring a decrease of an output of the exhaust gas sensor from a level greater than a first predetermined value, to a level smaller than or equal to the first predetermined value; and a third process element of allowing the air fuel ratio control when the exhaust gas sensor is judged to be in the active state.

According to still another aspect of the present invention, an exhaust sensor activation judging apparatus for detecting an active state of an exhaust gas sensor to be disposed in an exhaust passage of an internal combustion engine, comprises: a controller configured to monitor a decrease of an exhaust gas sensor output voltage below a bias voltage applied to the exhaust gas sensor, to produce an active condition signal representing the active state of the exhaust gas sensor when the sensor output voltage is equal to or lower than a first voltage.

DETAILED DESCRIPTION OF THE INVENTION

Figure 1:
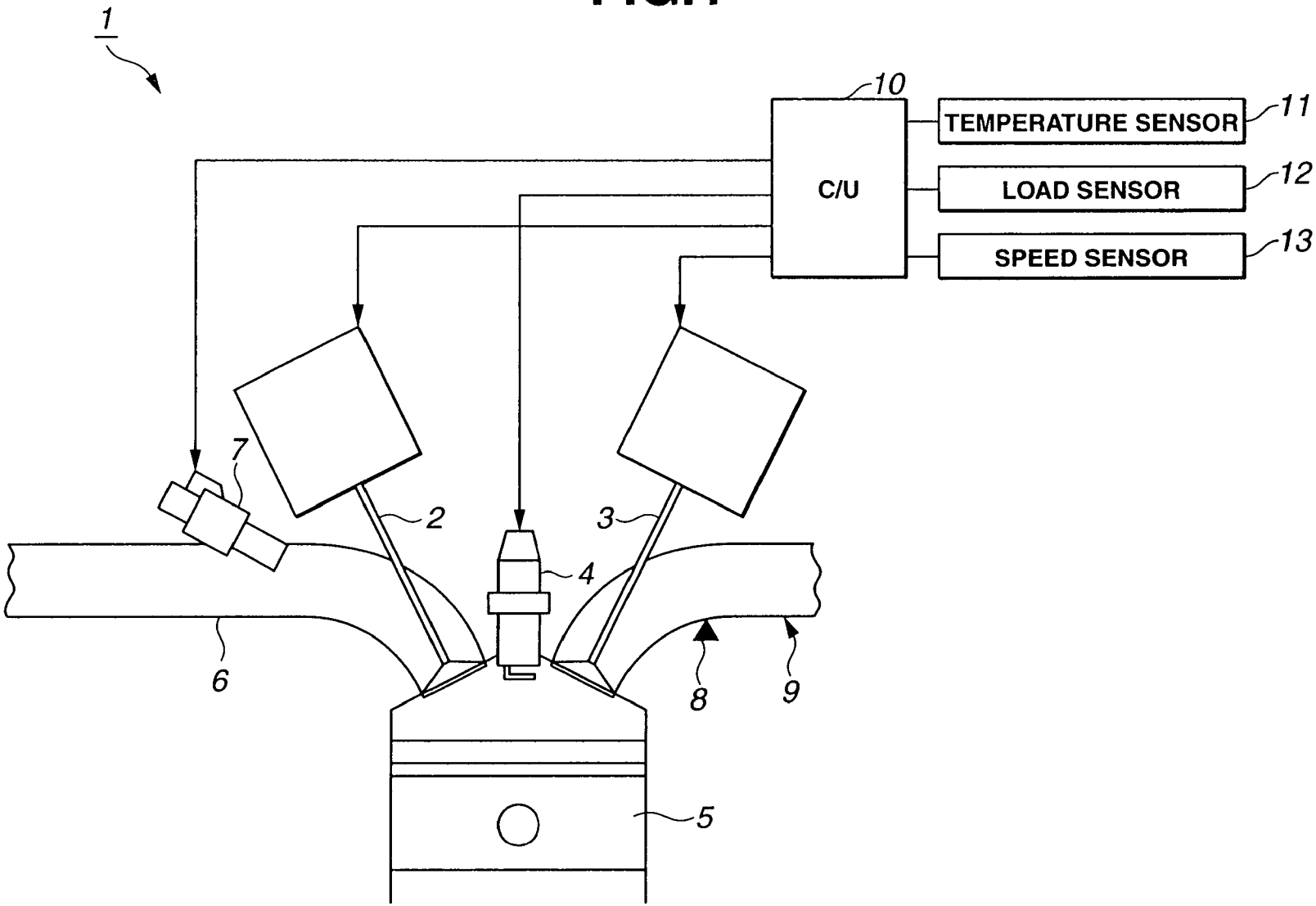
FIG. 1 is a schematic view showing an internal combustion engine provided with an air fuel ratio control system according to one embodiment of the present invention.

FIG. 1 shows an air fuel ratio control system according to one embodiment of the present invention. As shown in FIG. 1, an internal combustion engine (or engine system) 1 includes, as main components, at least one cylinder 5 including an intake valve 2, an exhaust valve 3 and a spark plug 4; a fuel injector (or fuel injection valve) 7 disposed in an intake port 6; an exhaust gas sensor 8 for sensing an oxygen concentration in an exhaust passage 9 or in an exhaust port; and a control unit 10 for controlling operations of intake and exhaust valves 2 and 3, spark plug 4, and fuel injector 7. Fuel injector 7 can serve as an actuator in an air fuel ratio control system, and control unit 10 can serve as a main unit of a controller in the air fuel ratio control system.

A temperature sensor or engine temperature sensor 11 senses an engine temperature or engine ambient temperature of engine 1, such as an engine coolant temperature, a lubricating oil temperature or ambient air temperature. A load sensor or engine load sensor 12 senses an engine load of engine 1 such as a throttle opening of engine 1. A speed sensor or engine speed sensor 13 senses an engine revolution speed of engine 1. These sensors are connected with control unit 10, and arranged to supply information on sensed engine operating conditions to control unit 10.

Figure 2:
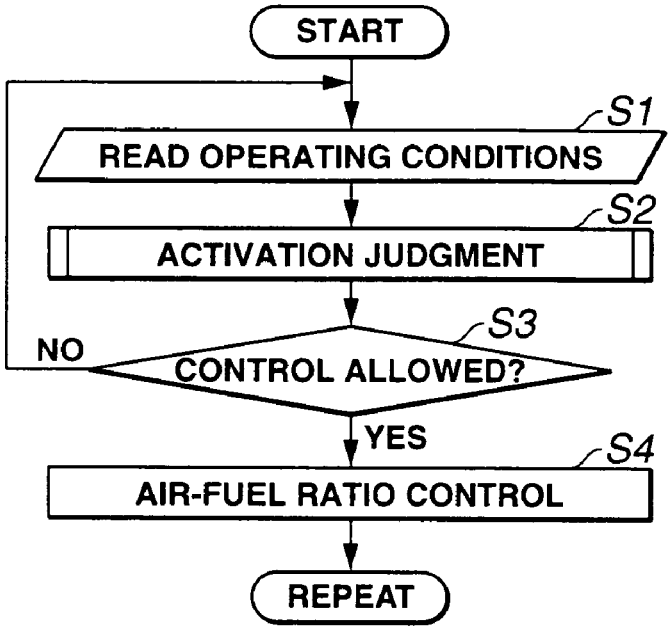
FIG. 2 is a flowchart showing an air fuel ratio control process according to the embodiment of the present invention.

FIG. 2 shows an air fuel ratio control process performed by control unit 10. By this air fuel ratio control process, the control system can make an accurate rich-lean judgment and control the air-fuel ratio accurately. The air fuel ratio control process is started when an ignition switch of a vehicle is turned on.

At a first step S1, control unit 10 reads information on operating conditions sensed by a sensor section. In this example, the sensor section includes temperature sensor 11, load sensor 12 and speed sensor 13. In accordance with the engine ambient temperature, engine load and engine speed sensed by sensors 11, 12 and 13, the control system determines a desired target air fuel ratio.

Figure 3:
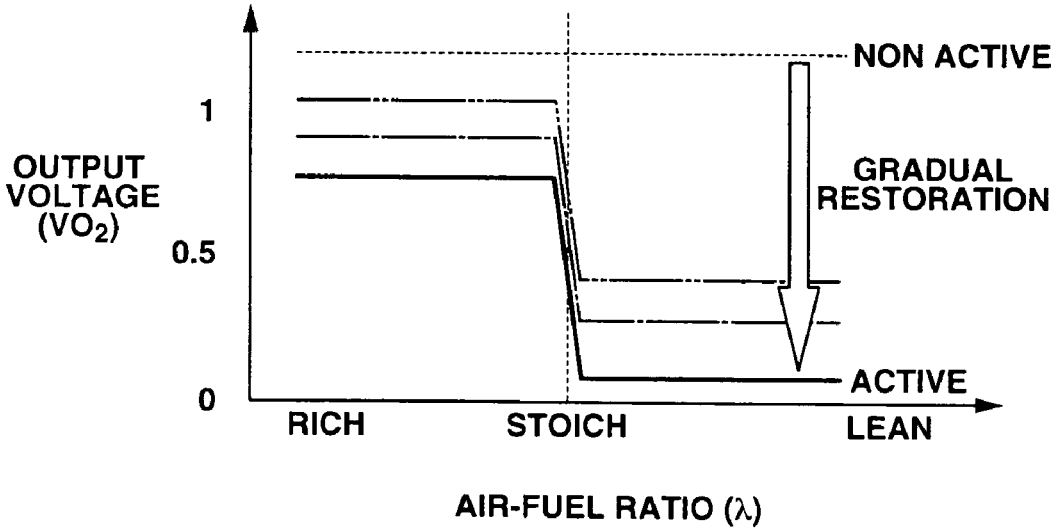
FIG. 3 is a graphic view showing a variation of a sensor output voltage of an exhaust gas sensor with an increase of the sensor temperature, which is monitored by the control system of FIG. 1.

At a step S2 following S1, control unit 10 reads control values (as mentioned later) corresponding to the information obtained at S1, and makes a judgment as to activation of exhaust gas sensor 8 in accordance with the control values. In general, an output voltage $VO_2$ of the exhaust gas sensor is approximately equal to a bias voltage without regard to the air fuel ratio when the exhaust gas sensor is a non-active state. With an increase of a sensing element's temperature, the output voltage VO2 approaches gradually to a rich side output (about 900 mV) and to a lean side output (100 mV), as shown by a downward outline arrow in FIG. 3. On the other hand, the air-fuel ratio of the internal combustion engine is in a rich state just after a start of the engine. Therefore, control unit 10 determines whether exhaust gas sensor 8 is activated or not, by examining whether the rich time output of exhaust gas sensor 8 is within a range in the active state on the rich side (left side as viewed in FIG. 3) with respect to the stoichiometry, as mentioned later.

After the activation judgment of S2, control unit 10 proceeds to a next step S3. At S3, control unit 10 checks the result of the activation judgment of S2, and examines whether exhaust gas sensor 8 is in the active state and the execution of the air fuel ratio control is allowed. When exhaust gas sensor 8 is in the non-active state and the air-fuel ratio control is not allowed, then control unit 10 returns from S3 to S1. When exhaust gas sensor 8 is in the active state and the air-fuel ratio control is allowed, then control unit 10 proceeds to a step S4 to perform the air-fuel ratio control.

At S4, control unit 10 performs the rich/lean judgment of the air-fuel ratio in accordance with the output value of exhaust gas sensor 8, and performs the air-fuel ratio control to bring the actual air-fuel ratio to the target air-fuel ratio. After the operation of the air-fuel ratio control at S4, control unit 10 returns to S1.

FIGS. 4, 6, 8, 10, 12, 14, 16, 18 and 20 are flowcharts showing nine practical examples of the activation judgment of S2 according to the this embodiment of the present invention.

Figure 4:
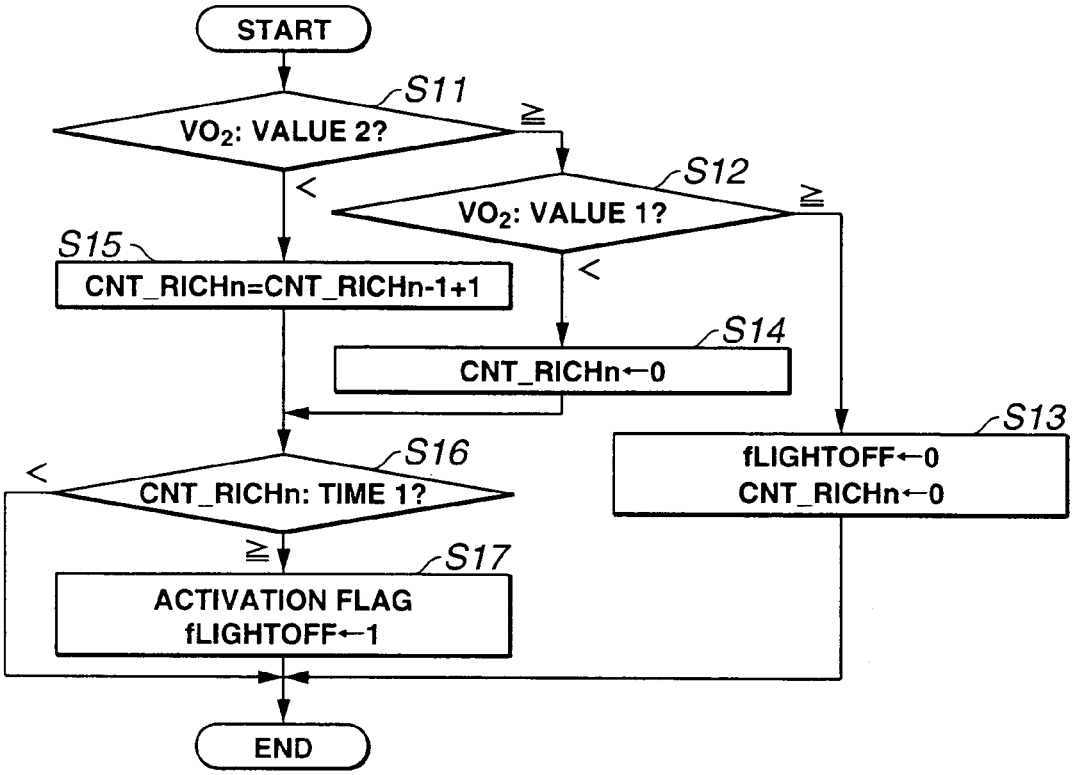
FIG. 4 is a flowchart showing an exhaust gas sensor-activation judgment process in a first practical example of the embodiment shown in FIGS. 1 and 2.

The activation judgment process of a first practical example shown in the flowchart of FIG. 4 is started after the control values (later-mentioned predetermined values) are set by the operation of S1.

At S11 shown in FIG. 4, control unit 10 examines whether output voltage $VO_2$ of exhaust gas sensor 8 is greater than or equal to a second predetermined value (value 2). The second predetermined value is a value within the range of output of exhaust gas sensor 8 in the active state. For example, the second predetermined value is equal to 750 [mV]. When output voltage $VO_2$ is less than the second predetermined value, control unit 10 proceeds from S11 to a step S15. When output voltage $VO_2$ is greater than or equal to the second predetermined value, control unit 10 proceeds from S11 to a step S12.

Figure 5:
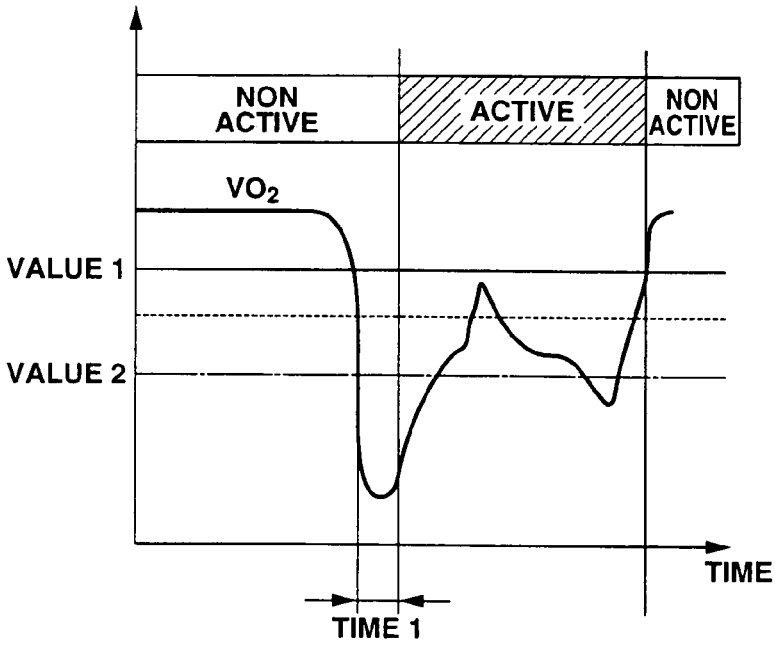
FIG. 5 is a graphic view showing time variation of the exhaust gas sensor output voltage for illustrating the activation judgment process of FIG. 4.

At S12, control unit 10 examines whether output voltage $VO_2$ of exhaust gas sensor 8 is greater than or equal to a first predetermined value (value 1). The first predetermined value (value 1) is greater than the second predetermined value (value 2) as shown in FIG. 5. The first predetermined value is a value within the range of rich side or rich time output of exhaust gas sensor 8 in the active state. For example, the first predetermined value is equal to 1100 [mV]. When output voltage $VO_2$ is greater than or equal to the first predetermined value, control unit 10 proceeds from S12 to a step S13, and sets an activation flag (or activation judgment flag) fLIGHTOFF and a time counter CNT_RICHn to zero. The activation flag (or activation judgment flag) fLIGHTOFF is a condition code which is equal to one when exhaust gas sensor 8 is in the active state, and which is equal to zero when exhaust gas sensor 8 is in the non-active state. Activation flag fLIGHTOFF is reset to zero at a start of the engine. The time counter CNT_RICHn is a counter for measuring a time duration of the output within the range in the active state of exhaust gas sensor 8. After S13, control unit 10 terminates the process of FIG. 4. When output voltage $VO_2$ is less than the first predetermined value, control unit 10 proceeds from S12 to a step S14. Control unit 10 resets the time counter CNT_RICHn to zero at S14, and then proceeds to a step S16.

At S15, control unit 10 increments (increases by one) the time counter CNT_RICHn (CNT_RICHn=CNT_RICHn−1+1). After S15, control unit 10 proceeds to S16.

At S16, control unit 10 examines whether the time counter CNT_RICHn is greater than or equal to a first time (time 1). In this example, the first time (time 1) is set to 10 (corresponding to 100 [ms]). When the time counter is smaller than the first time, control unit 10 terminates the process of FIG. 4. When the time counter is greater than or equal to the first time, control unit 10 proceeds from S16 to a step S17.

At S17, control unit 10 sets the activation (judgment) flag fLIGHTOFF to one to indicate that exhaust gas sensor 8 is in the active state. After S17, control unit 10 terminates the process of FIG. 4.

As shown in FIG. 5, in the first practical example of FIG. 4, the control system detects the activation of exhaust gas sensor 8 by checking a variation of sensor output voltage $VO_2$ from the range greater than the first predetermined value to the range smaller than or equal to the first predetermined value. When the exhaust gas sensor is in the non-active state, in general, there is formed a potential difference between both electrodes due to a bias voltage. This potential difference becomes smaller as the exhaust gas sensor is activated and the impedance decreases. Therefore, by the activation judgment process of FIG. 4, the air fuel control system can detect the activation of exhaust gas sensor 8 accurately, and thereby improve the accuracy of the air fuel ratio control by detecting the rich side and lean side of the air fuel ratio accurately.

In the activation judgment process of FIG. 4, the control system checks a decrease of the exhaust gas sensor output voltage $VO_2$ under the first predetermined value, and then checks a further decrease of the exhaust gas sensor output voltage $VO_2$ under the second predetermined value smaller than the first predetermined value. Therefore, the activation of the exhaust gas sensor can be detected accurately.

By checking the time duration of the sensor output voltage $VO_2$ remaining in the preset active output range, the control system can avoid misjudgment due to instantaneous decrease of the sensor output voltage, and thereby improve the reliability of the activation judgment.

Figure 6:
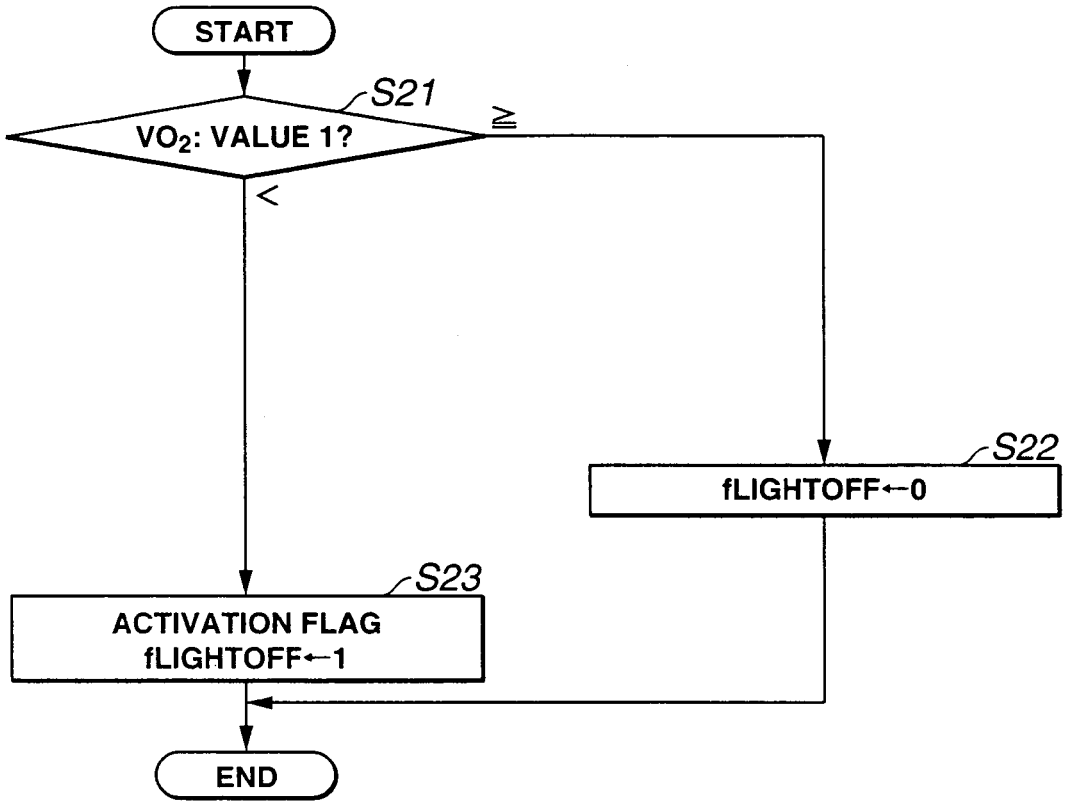
FIG. 6 is a flowchart showing an exhaust gas sensor activation judgment process in a second practical example of the embodiment shown in FIGS. 1 and 2.

FIG. 6 shows a second practical example. The activation judgment process shown in the flowchart of FIG. 6 is started from a step S21 after the control values are set by the operation of S1.

At S21 shown in FIG. 6, control unit 10 examines whether output voltage $VO_2$ of exhaust gas sensor 8 is greater than or equal to a first predetermined value (value 1). The first predetermined value of the second practical example is a value within the range of rich side or rich time output of exhaust gas sensor 8 in the active state. For example, the first predetermined value of the second practical example shown in FIG. 6 is equal to 1100 [mV]. When output voltage $VO_2$ is less than the first predetermined value, control unit 10 proceeds from S21 to a step S23. When output voltage $VO_2$ is greater than or equal to the first predetermined value, control unit 10 proceeds from S21 to a step S22.

At S22, control unit 10 resets the activation flag (or activation judgment flag) fLIGHTOFF to zero. The activation flag (or activation judgment flag) fLIGHTOFF is a condition code set to one to indicate that exhaust gas sensor 8 is activated, as in the first practical example. After S22, control unit 10 terminates the process of FIG. 6.

At S23, control unit 10 sets the activation (judgment) flag fLIGHTOFF to one to indicate that exhaust gas sensor 8 is in the active state. After S23, control unit 10 terminates the process of FIG. 6.

Figure 7:
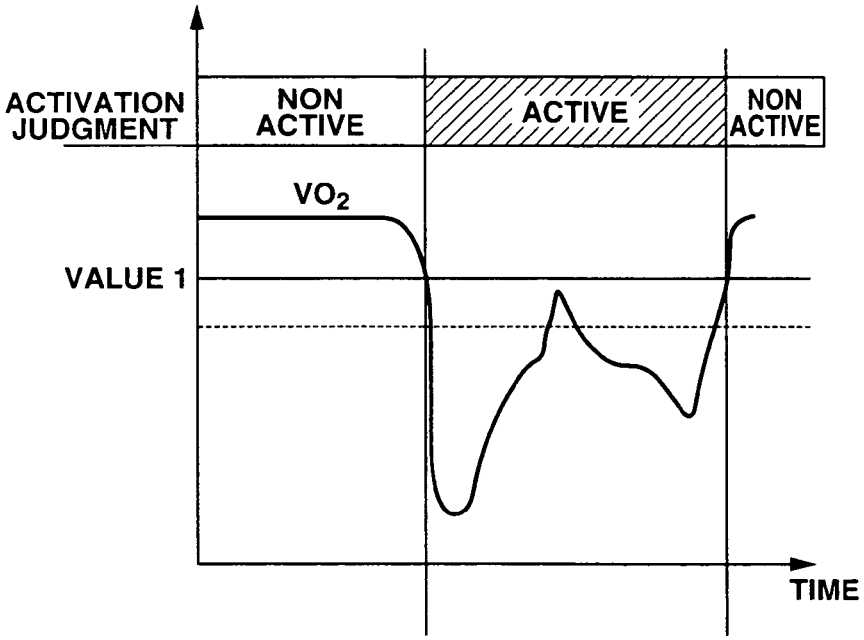
FIG. 7 is a graphic view showing time variation of the exhaust gas sensor output voltage for illustrating the activation judgment process of FIG. 6.

Thus, the control system of the second practical example can detect the activation of exhaust gas sensor 8 by checking a variation of sensor output voltage $VO_2$ from a level above the first predetermined value to a level below the first predetermined value, as shown in FIG. 7.

Figure 8:
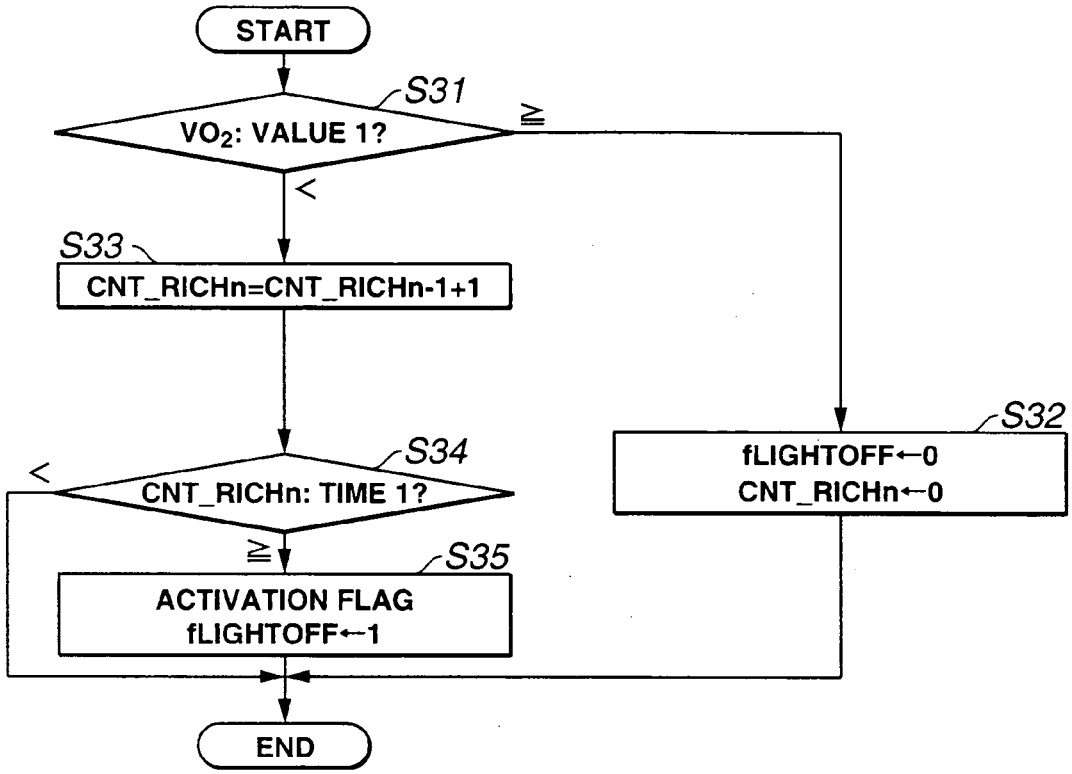
FIG. 8 is a flowchart showing an exhaust gas sensor activation judgment process in a third practical example of the embodiment shown in FIGS. 1 and 2.

FIG. 8 shows a third practical example. The activation judgment process shown in the flowchart of FIG. 8 is started from a step S31 after the control values are set by the operation of S1.

At S31 shown in FIG. 8, control unit 10 examines whether output voltage $VO_2$ of exhaust gas sensor 8 is greater than or equal to a first predetermined value (value 1). The first predetermined value of the third practical example is a value (1100 [mV], for example) within the range of rich side output of exhaust gas sensor 8 in the active state. When output voltage $VO_2$ is less than the first predetermined value, control unit 10 proceeds from S31 to a step S33. When output voltage $VO_2$ is greater than or equal to the first predetermined value, control unit 10 proceeds from S31 to a step S32.

At S32, control unit 10 resets the activation flag (or activation judgment flag) fLIGHTOFF to zero. Moreover, control unit 10 reset a time counter CNT_RICHn to zero, at S32. Time counter CNT_RICHn is a counter for measuring a time duration of an output within a active output range when exhaust gas sensor 8 is in the active state. After S32, control unit 10 terminates the process of FIG. 8.

At S33, control unit 10 increments (increases by one) the time counter CNT_RICHn. After S33, control unit 10 proceeds to a step S34.

At S34, control unit 10 examines whether the time counter CNT_RICHn is greater than or equal to a predetermined first time (or first time interval)(time 1). In this example, the predetermined first time (interval) is equal to 10 (corresponding to 100 ms). When time counter CNT_RICHn is less than the predetermined first time (time 1), control unit 10 terminates the process of FIG. 8. When time counter CNT_RICHn is greater than or equal to the predetermined first time (time 1), control unit 10 proceeds from S34 to a step S35.

At S35, control unit 10 sets the activation (judgment) flag fLIGHTOFF to one to indicate that exhaust gas sensor 8 is in the active state. After S35, control unit 10 terminates the process of FIG. 8.

Figure 9:
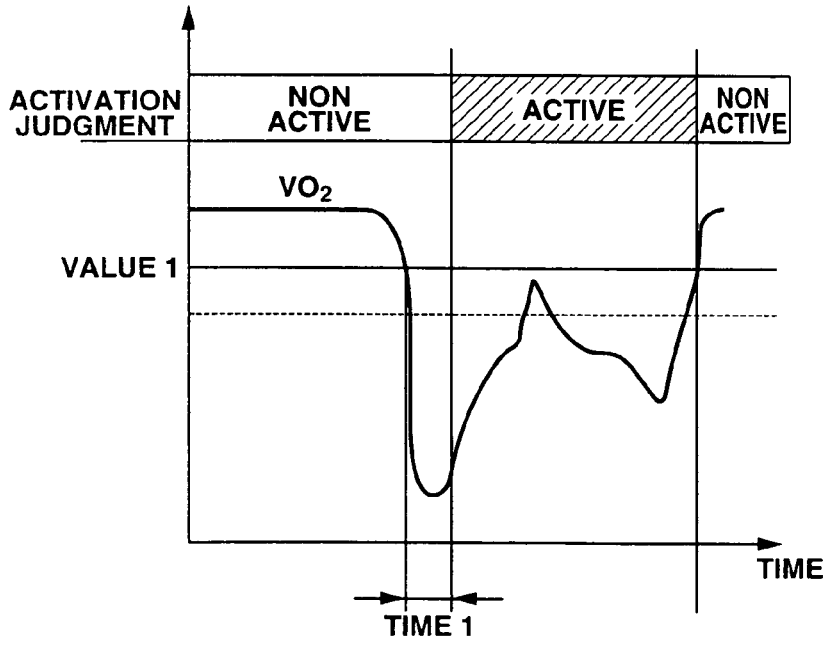
FIG. 9 is a graphic view showing time variation of the exhaust gas sensor output voltage for illustrating the activation judgment process of FIG. 8.

Thus, the control system of the third practical example can detect the activation of exhaust gas sensor 8 more accurately by checking a variation of sensor output voltage $VO_2$ from the range above the first predetermined value to the range below the first predetermined value, and by further checking the time duration of the sensor output voltage $VO_2$ remaining in the preset active output range, as shown in FIG. 9.

Figure 10:
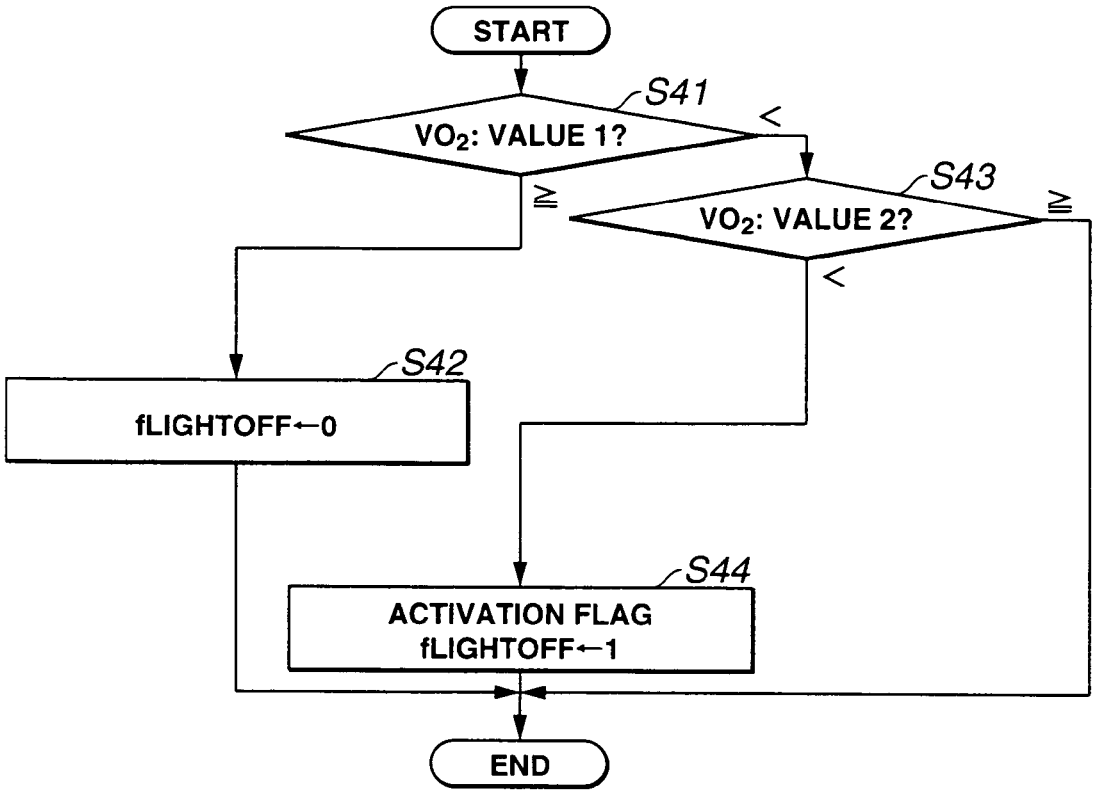
FIG. 10 is a flowchart showing an exhaust gas sensor activation judgment process in a fourth practical example of the embodiment shown in FIGS. 1 and 2.

FIG. 10 shows a fourth practical example. The activation judgment process shown in the flowchart of FIG. 10 is started from a step S41 after the control values are set by the operation of S1.

At S41 shown in FIG. 10, control unit 10 examines whether output voltage $VO_2$ of exhaust gas sensor 8 is greater than or equal to a first predetermined value (value 1). The first predetermined value of the third practical example is a value (1100 [mV], for example) within the range of rich time output of exhaust gas sensor 8 in the active state. When output voltage $VO_2$ is less than the first predetermined value, control unit 10 proceeds from S41 to a step S43. When output voltage $VO_2$ is greater than or equal to the first predetermined value, control unit 10 proceeds from S41 to a step S42.

At S42, control unit 10 resets the activation flag (or activation judgment flag) fLIGHTOFF to zero. After S42, control unit 10 terminates the process of FIG. 10.

Figure 11:
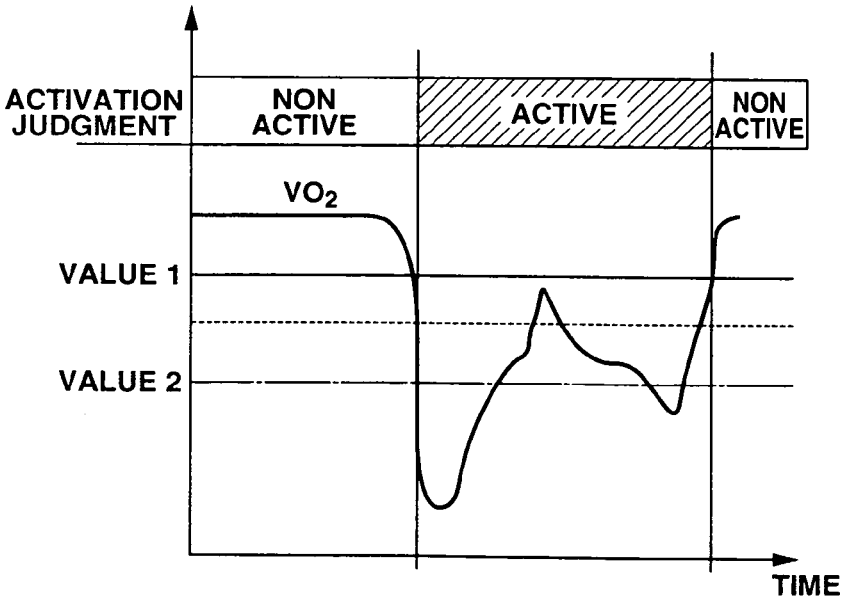
FIG. 11 is a graphic view showing time variation of the exhaust gas sensor output voltage for illustrating the activation judgment process of FIG. 10.

At S43, control unit 10 examines whether output voltage $VO_2$ of exhaust gas sensor 8 is greater than or equal to a second predetermined value (value 2). The second predetermined value (value 2) of the fourth practical example of FIG. 10 is smaller than the first predetermined value (value 1) as shown in FIG. 11. For example, the second predetermined value of the fourth practical example is equal to 750 [mV]. When output voltage $VO_2$ is greater than or equal to the second predetermined value, control unit 10 terminates the process of FIG. 10. When output voltage $VO_2$ is smaller than the second predetermined value, control unit 10 proceeds from S43 to a step S44.

At S44, control unit 10 sets the activation (judgment) flag fLIGHTOFF to one to indicate that exhaust gas sensor 8 is in the active state. After S44, control unit 10 terminates the process of FIG. 10.

Figure 12:
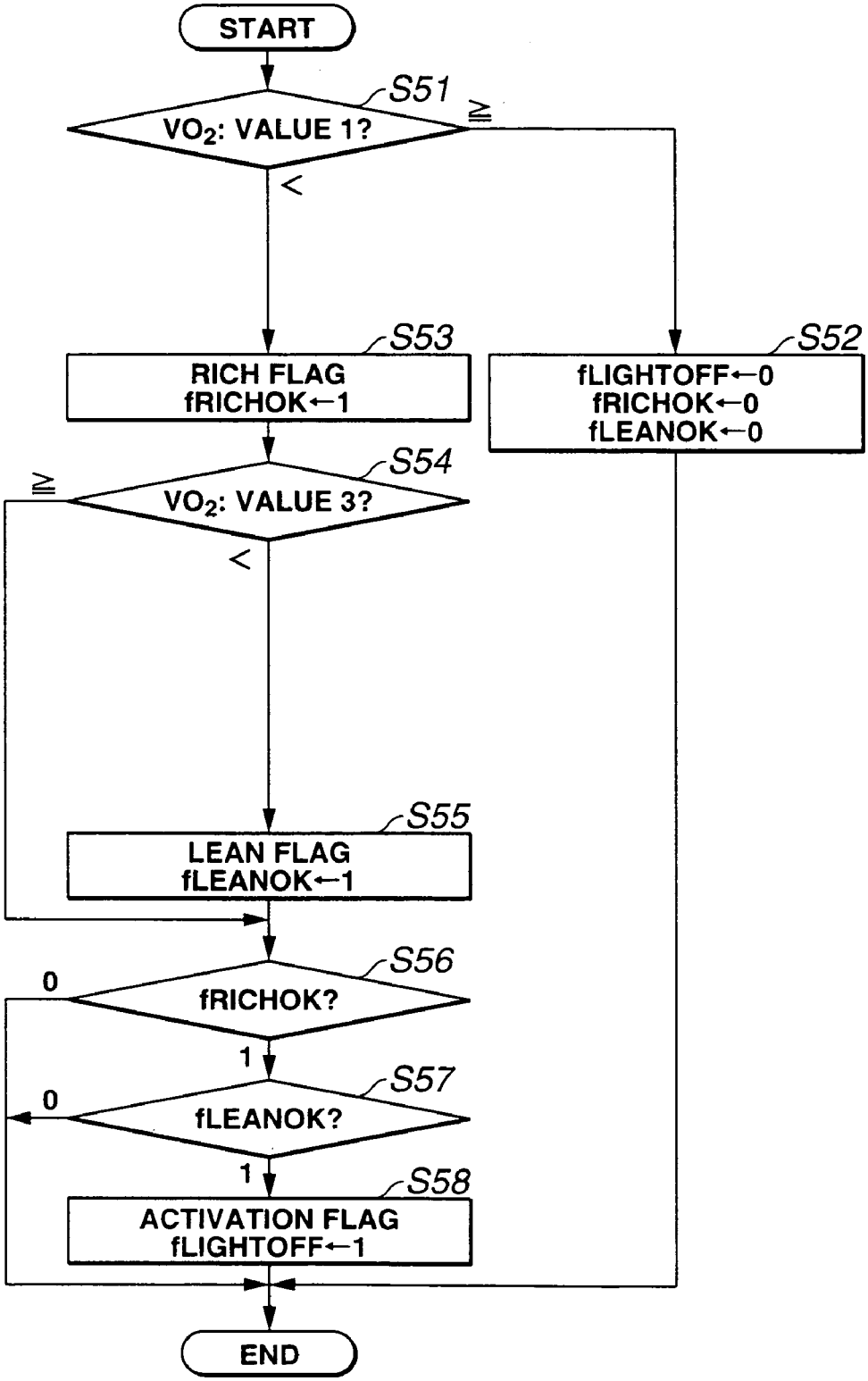
FIG. 12 is a flowchart showing an exhaust gas sensor activation judgment process in a fifth practical example of the embodiment shown in FIGS. 1 and 2.

FIG. 12 shows a fifth practical example. The activation judgment process shown in the flowchart of FIG. 12 is started from a step S51 after the control values are set by the operation of S1.

Figure 13:
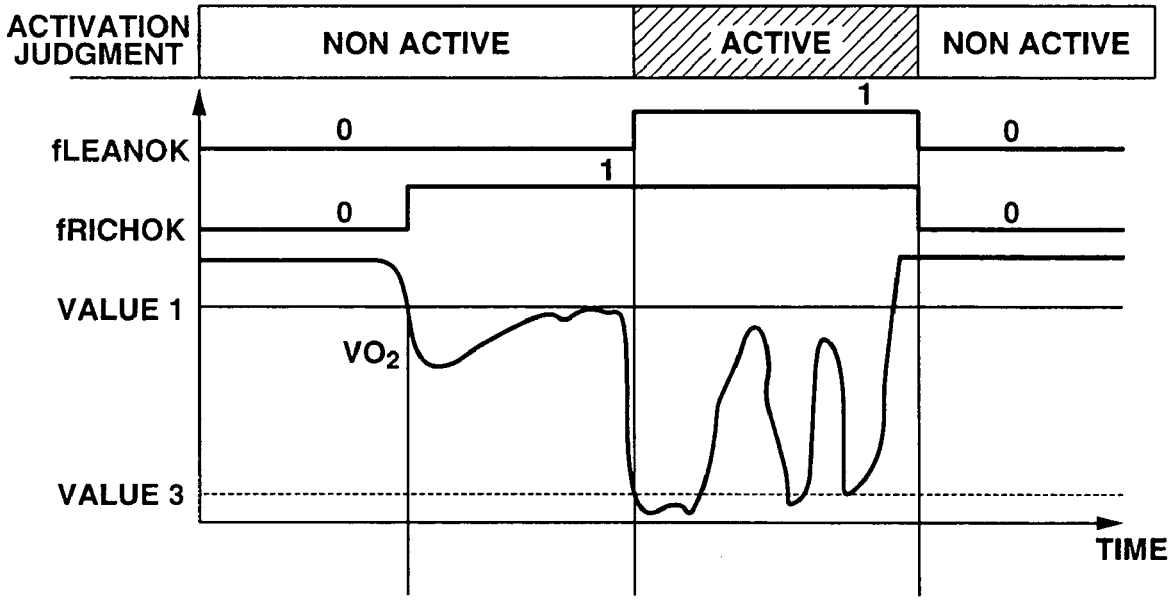
FIG. 13 is a graphic view showing time variation of the exhaust gas sensor output voltage for illustrating the activation judgment process of FIG. 12.

At S51 shown in FIG. 12, control unit 10 examines whether output voltage $VO_2$ of exhaust gas sensor 8 is greater than or equal to a first predetermined value (value 1). The first predetermined value of the third practical example is a value (1100 [mV], for example) within the range of rich time output of exhaust gas sensor 8 in the active state, as shown in FIG. 13. When output voltage $VO_2$ is greater than or equal to the first predetermined value, control unit 10 proceeds from S51 to a step S52. When, on the other hand, the output voltage $VO_2$ is less than the first predetermined value, control unit 10 proceeds from S51 to a step S53.

At S52, control unit 10 resets each of activation flag (or activation judgment flag) fLIGHTOFF, an active output judgment flag fRICHOK and a lean output judgment flag fLEANOK to zero. The output judgment flag (or rich flag) fRICHOK is a condition code which is equal to one when the output voltage $VO_2$ of exhaust gas sensor 8 is smaller than the first value, and which is equal to zero when output voltage $VO_2$ of exhaust gas sensor 8 is equal to or greater than the first value. The output judgment flag fRICHOK is reset to zero at the time of an engine start. The lean output judgment flag (or lean flag) fLEANOK is a condition code which is equal to one when the output voltage $VO_2$ of exhaust gas sensor 8 is smaller than a predetermined third value, and equal to zero when the output voltage $VO_2$ of exhaust gas sensor 8 is equal to or greater than the third value. The lean output judgment flag fLEANOK is reset to zero at the time of an engine start. After S52, control unit 10 terminates the process of FIG. 12.

At S53, control unit 10 sets the output judgment flag fRICHOK to one. After S53, control unit 10 proceeds to a step S54.

At S54, control unit 10 examines whether output voltage $VO_2$ of exhaust gas sensor 8 is greater than or equal to the third predetermined value (value 3). The third predetermined value (value 3) of the fifth practical example of FIG. 12 is smaller than the first predetermined value (value 1), as shown in FIG. 13. The third predetermined value of the fifth practical example is a value (lean side value or low value) within the range of lean side output of exhaust gas sensor 8 in the active state. For example, the third predetermined value of the fifth practical example is equal to 200 [mV]. When output voltage $VO_2$ is greater than or equal to the third predetermined value, control unit 10 proceeds from S54 directly to a step S56. When output voltage $VO_2$ is smaller than the third predetermined value, control unit 10 proceeds from S54 to a step S55.

At S55, control unit 10 sets the lean output judgment flag fLEANOK to one. After S55, control unit 10 proceeds to S56.

At S56, control unit 10 examines whether the output judgment flag fRICHOK is equal to one or not. When output judgment flag fRICHOK is not equal to one, then control unit 10 terminates the process of FIG. 12. When output judgment flag fRICHOK is equal to one, then control unit 10 proceeds from S56 to a step S57.

At S57, control unit 10 examines whether the lean output judgment flag fLEANOK is equal to one or not. When lean output judgment flag fLEANOK is not equal to one, then control unit 10 terminates the process of FIG. 12. When lean output judgment flag fLEANOK is equal to one, then control unit 10 proceeds from S57 to a step S58.

At S58, control unit 10 sets the activation (judgment) flag fLIGHTOFF to one to indicate that exhaust gas sensor 8 is in the active state. After S58, control unit 10 terminates the process of FIG. 12.

Figure 14:
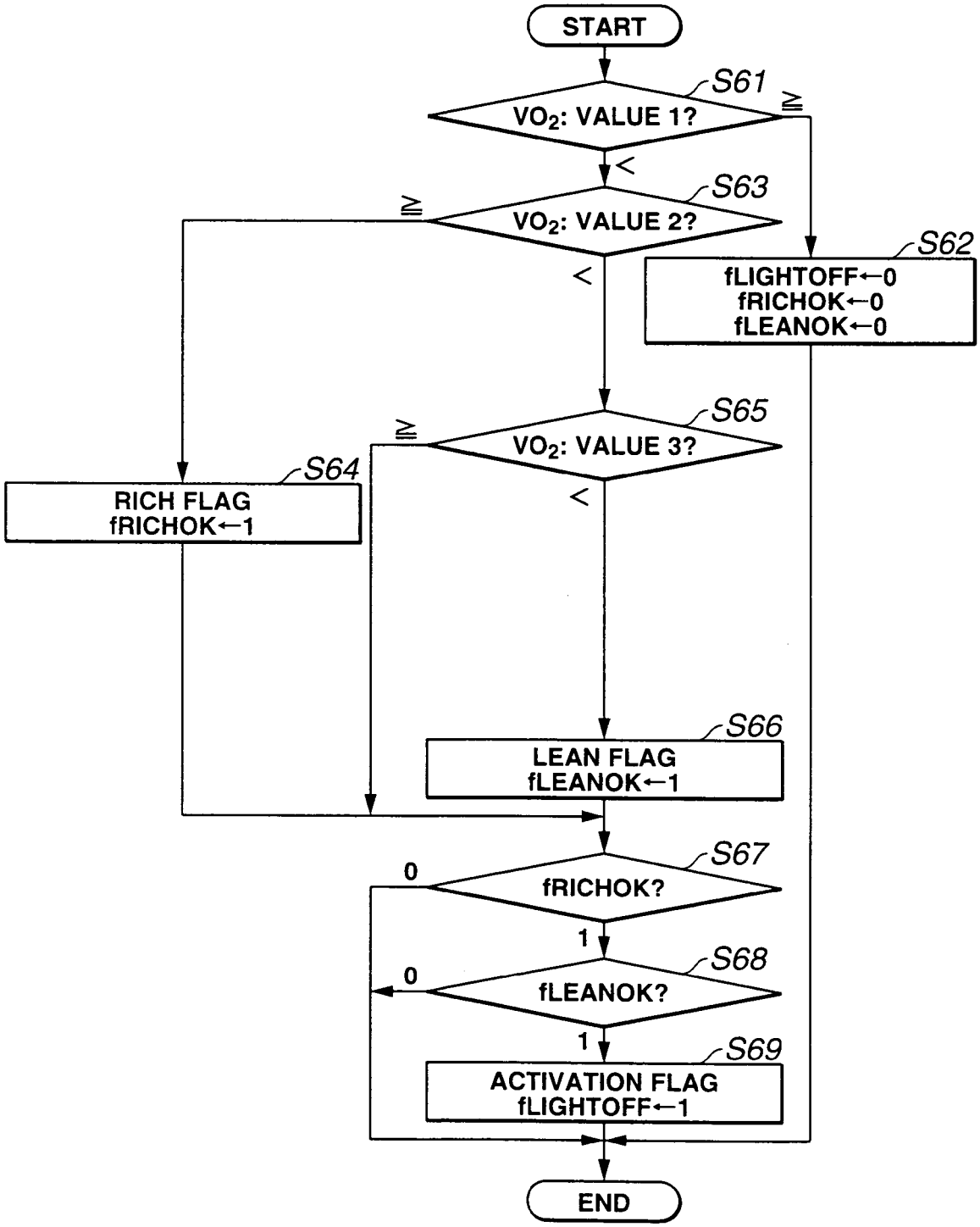
FIG. 14 is a flowchart showing an exhaust gas sensor activation judgment process in a sixth practical example of the embodiment shown in FIGS. 1 and 2.

FIG. 14 shows a sixth practical example. The activation judgment process shown in the flowchart of FIG. 14 is started from a step S61 after the control values are set by the operation of S1.

At S61 shown in FIG. 14, control unit 10 examines whether output voltage $VO_2$ of exhaust gas sensor 8 is greater than or equal to a first predetermined value (value 1). The first predetermined value of the third practical example is a value (1100 [mV], for example) within the range of rich time or rich side output of exhaust gas sensor 8 in the active state. When output voltage $VO_2$ is greater than or equal to the first predetermined value, control unit 10 proceeds from S61 to a step S62. When, on the other hand, the output voltage $VO_2$ is less than the first predetermined value, control unit 10 proceeds from S61 to a step S63.

At S62, control unit 10 resets each of activation flag (or activation judgment flag) fLIGHTOFF, active output judgment flag fRICHOK and lean output judgment flag fLEANOK to zero. The active output judgment flag (or rich flag) fRICHOK is a condition code which is equal to one when the output voltage $VO_2$ of exhaust gas sensor 8 is smaller than the first value, and which is equal to zero when output voltage $VO_2$ of exhaust gas sensor 8 is equal to or greater than the first value. The active output judgment flag fRICHOK is reset to zero at the time of an engine start. The lean output judgment flag (or lean flag) fLEANOK is a condition code which is equal to one when the output voltage $VO_2$ of exhaust gas sensor 8 is smaller than a predetermined third value, and equal to zero when the output voltage $VO_2$ of exhaust gas sensor 8 is equal to or greater than the third value. The lean output judgment flag fLEANOK is reset to zero at the time of an engine start. After S62, control unit 10 terminates the process of FIG. 14.

Figure 15:
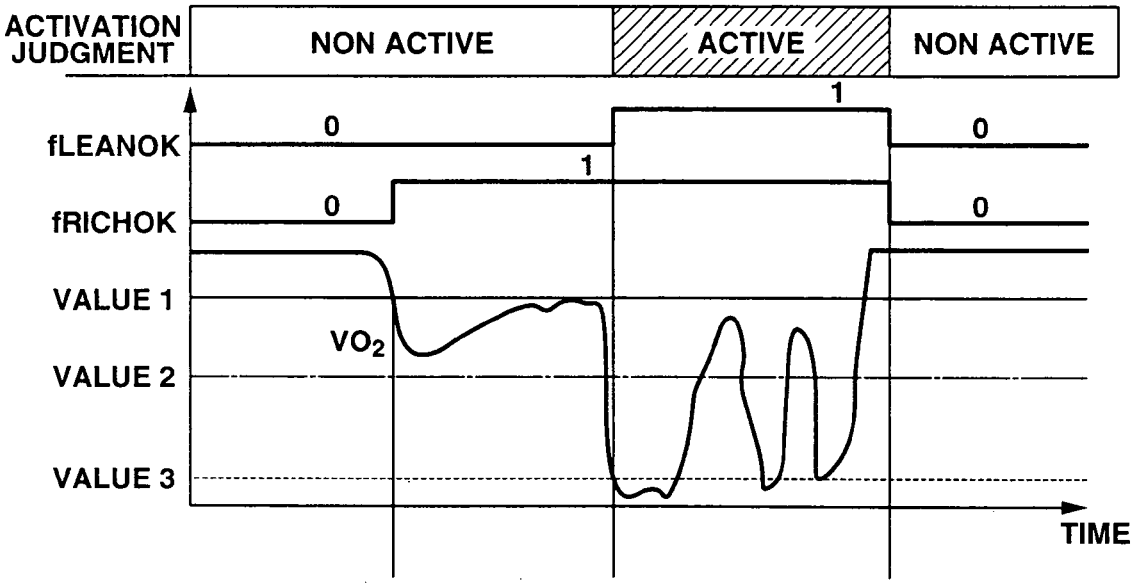
FIG. 15 is a graphic view showing time variation of the exhaust gas sensor output voltage for illustrating the activation judgment process of FIG. 14.

At S63, control unit 10 examines whether output voltage $VO_2$ of exhaust gas sensor 8 is greater than or equal to a second predetermined value (value 2). The second predetermined value (value 2) of the sixth practical example of FIG. 14 is smaller than the first predetermined value (value 1) as shown in FIG. 15. For example, the second predetermined value of the sixth practical example is equal to 900 [mV]. When output voltage $VO_2$ is greater than or equal to the second predetermined value, control unit 10 proceeds from S63 to a step S64. When output voltage $VO_2$ is smaller than the second predetermined value, control unit 10 proceeds from S63 to a step S65.

At S64, control unit 10 sets the output judgment flag fRICHOK to one. After S64, control unit 10 proceeds to S67.

At S65, control unit 10 examines whether output voltage $VO_2$ of exhaust gas sensor 8 is greater than or equal to the third predetermined value (value 3). The third predetermined value (value 3) of the sixth practical example of FIG. 14 is smaller than the second predetermined value (value 2) as shown in FIG. 15. For example, the third predetermined value of the sixth practical example is equal to 200 [mV]. When output voltage $VO_2$ is greater than or equal to the third predetermined value, control unit 10 proceeds from S65 to the step S67. When output voltage $VO_2$ is smaller than the third predetermined value, control unit 10 proceeds from S65 to a step S66.

At S66, control unit 10 sets the lean output judgment flag fLEANOK to one. After S66, control unit 10 proceeds to S67.

At S67, control unit 10 examines whether the active output judgment flag fRICHOK is equal to one or not. When the output judgment flag fRICHOK is not equal to one, then control unit 10 terminates the process of FIG. 14. When the output judgment flag fRICHOK is equal to one, then control unit 10 proceeds from S67 to a step S68.

At S68, control unit 10 examines whether the lean output judgment flag fLEANOK is equal to one or not. When lean output judgment flag fLEANOK is not equal to one, then control unit 10 terminates the process of FIG. 14. When lean output judgment flag fLEANOK is equal to one, then control unit 10 proceeds from S68 to a step S69.

At S69, control unit 10 sets the activation (judgment) flag fLIGHTOFF to one to indicate that exhaust gas sensor 8 is in the active state. After S69, control unit 10 terminates the process of FIG. 14.

Figure 16:
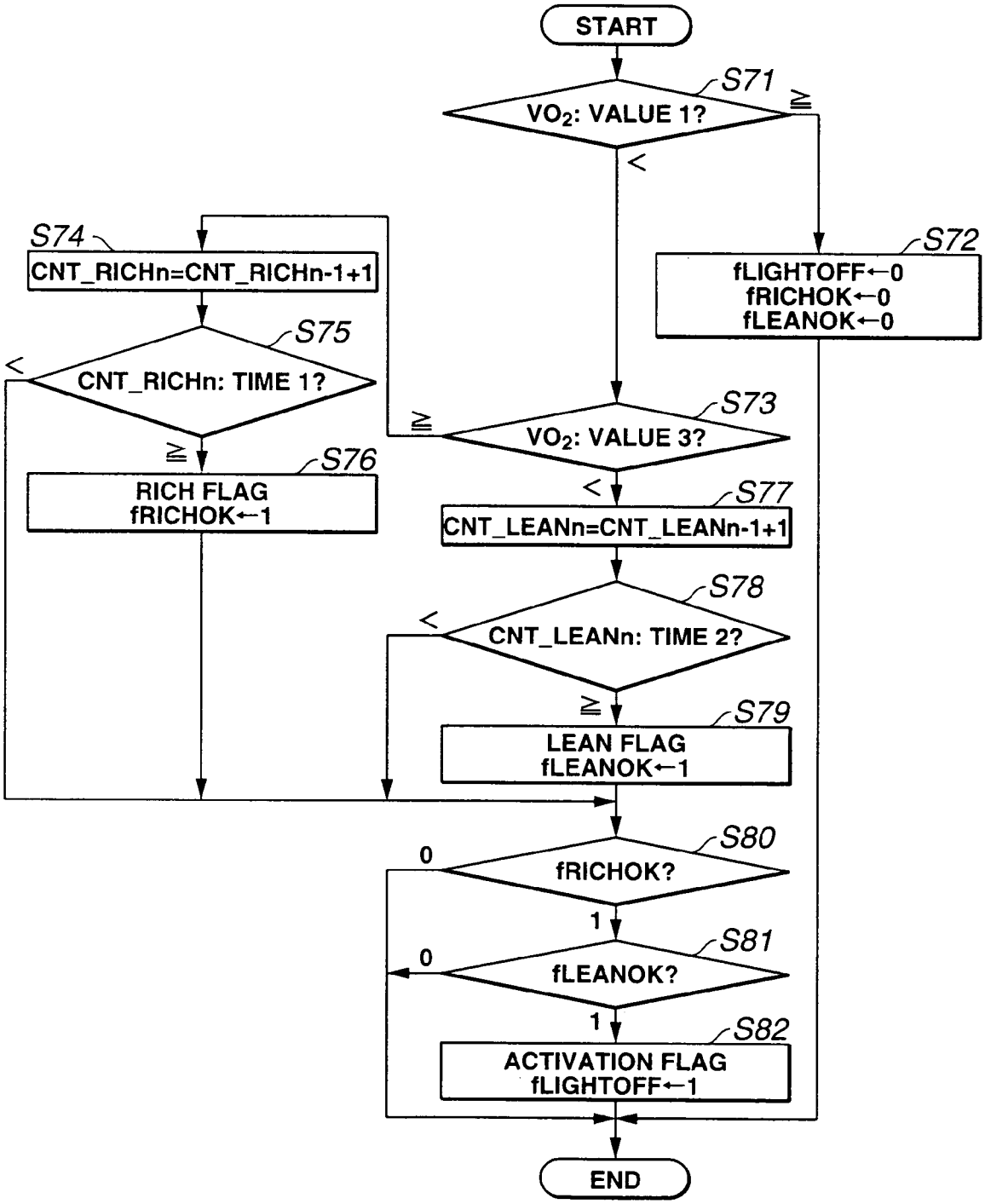
FIG. 16 is a flowchart showing an exhaust gas sensor activation judgment process in a seventh practical example of the embodiment shown in FIGS. 1 and 2.

FIG. 16 shows a seventh practical example. The activation judgment process shown in the flowchart of FIG. 16 is started from a step S71 after the control values are set by the operation of S1.

At S71 shown in FIG. 16, control unit 10 examines whether output voltage $VO_2$ of exhaust gas sensor 8 is greater than or equal to a first predetermined value (value 1). The first predetermined value of the third practical example is a value (1100 [mV], for example) within the range of rich side output of exhaust gas sensor 8 in the active state. When output voltage $VO_2$ is greater than or equal to the first predetermined value, control unit 10 proceeds from S71 to a step S72. When, on the other hand, the output voltage $VO_2$ is less than the first predetermined value, control unit 10 proceeds from S71 to a step S73.

At S72, control unit 10 resets each of activation flag (or activation judgment flag) fLIGHTOFF, active output judgment flag fRICHOK and lean output judgment flag fLEANOK to zero. The activation flag (or activation judgment flag) fLIGHTOFF is a condition code set to one to indicate that exhaust gas sensor 8 is activated, as in the first practical example. The active output judgment flag fRICHOK is a condition code which is set to one when the output voltage $VO_2$ of exhaust gas sensor 8 continues to be within an active output range for a time equal to or longer than a predetermined duration (a predetermined first time (interval) time 1); which is set to zero when the output voltage $VO_2$ of exhaust gas sensor 8 fails to continue to be within the active output range for a time equal to or longer than the predetermined duration (time 1); and which is reset to zero at the time of an engine start. The lean output judgment flag fLEANOK is a condition code which is set to one when the output voltage $VO_2$ of exhaust gas sensor 8 continues to be within a lean side active range for a time equal to or longer than a predetermined duration (a predetermined second time, time 2); which is set to zero when the output voltage $VO_2$ of exhaust gas sensor 8 fails to continue to be within the lean side active range for a time equal to or longer than the predetermined duration (time 2); and which is reset to zero at the time of an engine start. After S72, control unit 10 terminates the process of FIG. 16.

Figure 17:
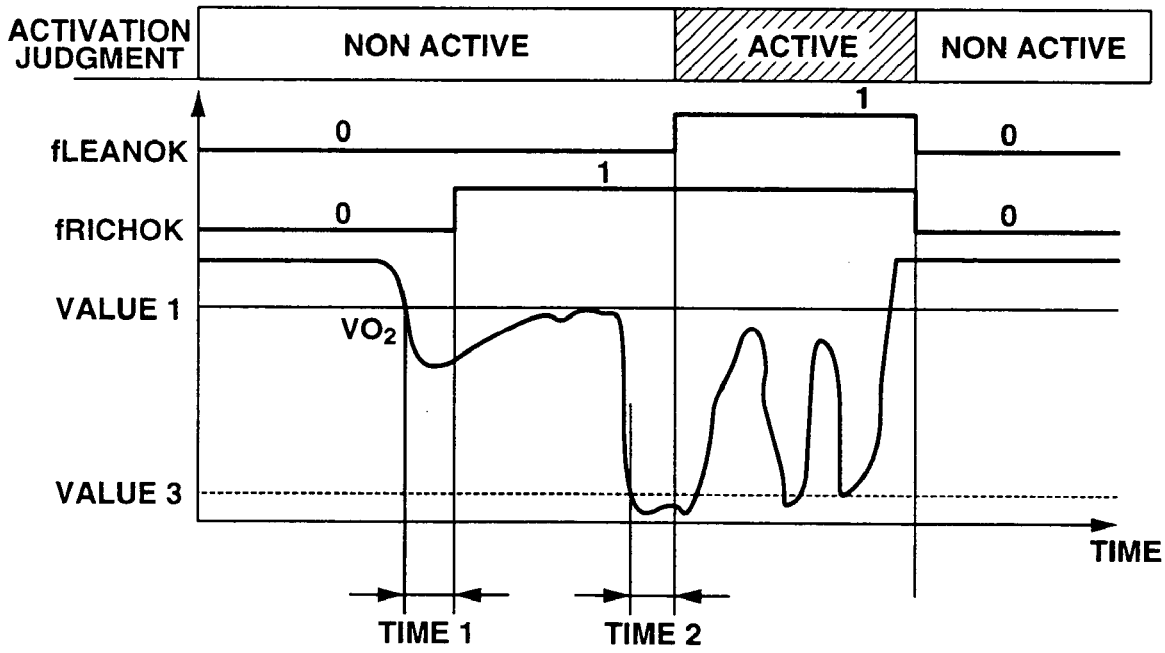
FIG. 17 is a graphic view showing time variation of the exhaust gas sensor output voltage for illustrating the activation judgment process of FIG. 16.

At S73, control unit 10 examines whether output voltage $VO_2$ of exhaust gas sensor 8 is greater than or equal to a third predetermined value (value 3). The third predetermined value (value 3) of the seventh practical example of FIG. 16 is smaller than the first predetermined value (value 1) as shown in FIG. 17. For example, the third predetermined value of the seventh practical example is equal to 200 [mV]. When output voltage $VO_2$ is smaller than the third predetermined value, control unit 10 proceeds from S73 to a step S77. When output voltage $VO_2$ is greater than or equal to the third predetermined value, control unit 10 proceeds from S73 to a step S74.

At S74, control unit 10 increments (increases by one) a time counter CNT_RICHn for measuring a time duration of an active output within an active output range when exhaust gas sensor 8 is in the active state. After S74, control unit 10 proceeds to a step S75.

At S75, control unit 10 examines whether the time counter CNT_RICHn is greater than or equal to a predetermined first time (interval) (time 1). In this example, the predetermined first time is equal to 10 (corresponding to 100 ms). When rich time counter CNT_RICHn is smaller than the predetermined first time (time 1), control unit 10 proceeds from S75 to a step S80. When the time counter CNT_RICHn is greater than or equal to the predetermined first time (time 1), control unit 10 proceeds from S75 to a step S76. At S76, control unit 10 sets the active output judgment flag fRICHOK to one. After S76, control unit 10 proceeds to S80.

At S77, control unit 10 increments (increases by one) a lean time counter CNT_LEANn for measuring a duration of a lean side output within a lean active output range when exhaust gas sensor 8 is in the active state. After S77, control unit 10 proceeds to a step S78.

At S78, control unit 10 examines whether the lean time counter CNT_LEANn is greater than or equal to a predetermined second time (time 2). In this example, the predetermined second time (interval) is equal to 10 (corresponding to 100 ms). When lean time counter CNT_LEANn is smaller than the predetermined second time (time 2), control unit 10 proceeds from S78 to S80. When lean time counter CNT_LEANn is greater than or equal to the predetermined second time (time 2), control unit 10 proceeds from S78 to a step S79. At S79, control unit 10 sets the lean output judgment flag fLEANOK to one. After S79, control unit 10 proceeds to S80.

At S80, control unit 10 examines whether the active output judgment flag fRICHOK is equal to one or not. When the output judgment flag fRICHOK is not equal to one, then control unit 10 terminates the process of FIG. 16. When rich output judgment flag fRICHOK is equal to one, then control unit 10 proceeds from S80 to a step S81.

At S81, control unit 10 examines whether the lean output judgment flag fLEANOK is equal to one or not. When lean output judgment flag fLEANOK is not equal to one, then control unit 10 terminates the process of FIG. 16. When lean output judgment flag fLEANOK is equal to one, then control unit 10 proceeds from S81 to a step S82.

At S82, control unit 10 sets the activation (judgment) flag fLIGHTOFF to one to indicate that exhaust gas sensor 8 is in the active state. After S82, control unit 10 terminates the process of FIG. 16.

Figure 18:
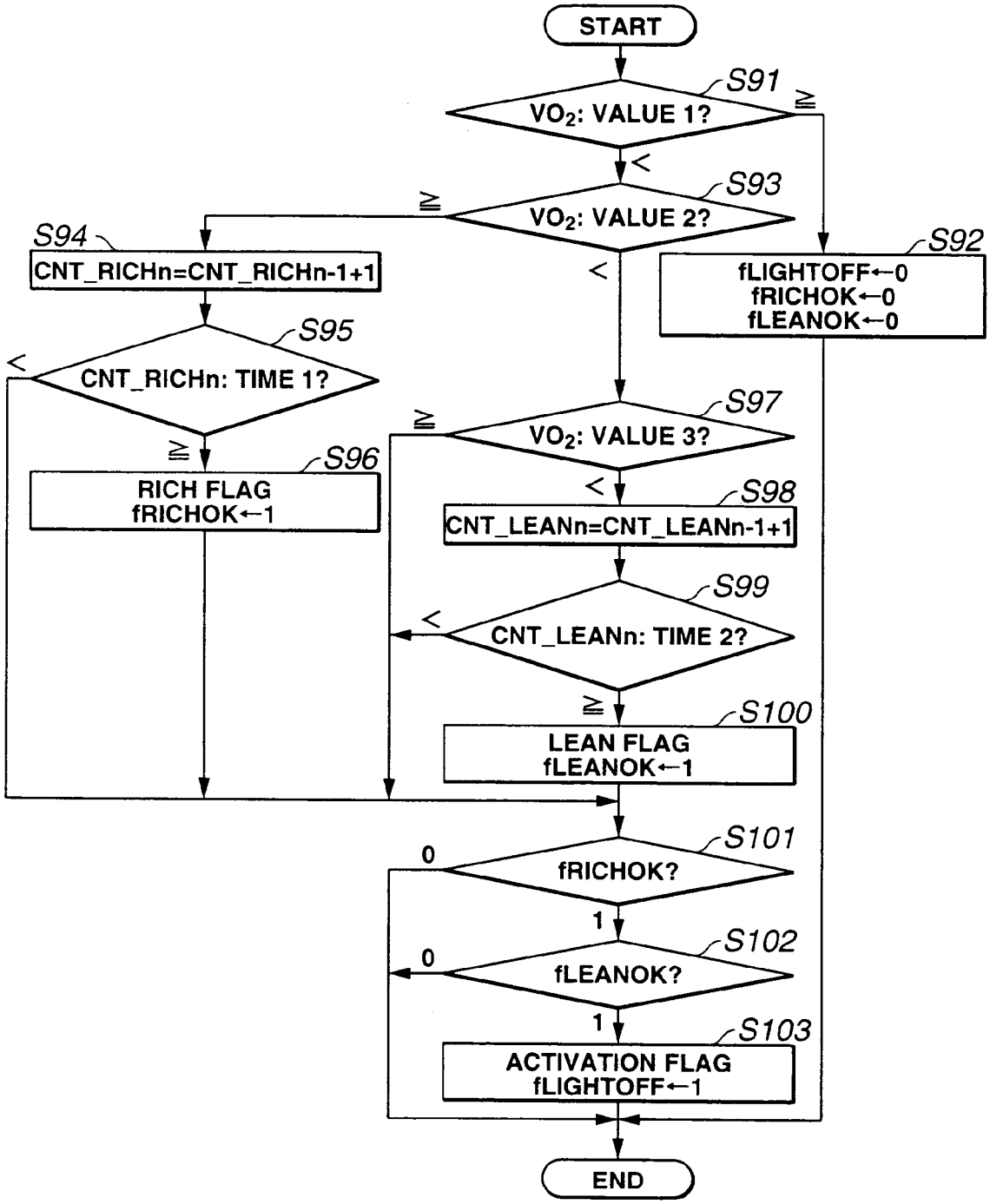
FIG. 18 is a flowchart showing an exhaust gas sensor activation judgment process in an eighth practical example of the embodiment shown in FIGS. 1 and 2.

FIG. 18 shows an eighth practical example of the activation judgment of S2 according to the present embodiment of the invention.

The activation judgment process shown in the flowchart of FIG. 18 is started after the control values are set by the operation of S1.

At S91 shown in FIG. 18, control unit 10 examines whether output voltage $VO_2$ of exhaust gas sensor 8 is greater than or equal to a first predetermined value (value 1). The first predetermined value of the eighth practical example is a value within the range of rich side output of exhaust gas sensor 8 in the active state. For example, the first predetermined value of the eighth practical example shown in FIG. 18 is equal to 1100 [mV]. When output voltage $VO_2$ is less than the first predetermined value, control unit 10 proceeds from S91 to a step S93. When output voltage $VO_2$ is greater than or equal to the first predetermined value, control unit 10 proceeds from S91 to a step S92.

At S92, control unit 10 resets each of the activation flag (or activation judgment flag) fLIGHTOFF, the active (rich) output judgment flag fRICHOK and the lean output judgment flag fLEANOK to zero. The activation flag (or activation judgment flag) fLIGHTOFF is a condition code set to one to indicate that exhaust gas sensor 8 is activated, as in the first practical example. The active output judgment flag fRICHOK is a condition code which is set to one when the output voltage $VO_2$ of exhaust gas sensor 8 continues to be within an active range for a time equal to or longer than a predetermined duration (a predetermined first time (interval) time 1); which is set to zero when the output voltage $VO_2$ of exhaust gas sensor 8 fails to continue to be within the active range for a time equal to or longer than the predetermined duration (time 1); and which is reset to zero at the time of an engine start. The lean output judgment flag fLEANOK is a condition code which is set to one when the output voltage $VO_2$ of exhaust gas sensor 8 continues to be within a lean side active range for a time equal to or longer than a predetermined duration (a predetermined second time, time 2); which is set to zero when the output voltage $VO_2$ of exhaust gas sensor 8 fails to continue to be within the lean side active range for a time equal to or longer than the predetermined duration (time 2); and which is reset to zero at the time of an engine start. After S92, control unit 10 terminates the process of FIG. 18.

Figure 19:
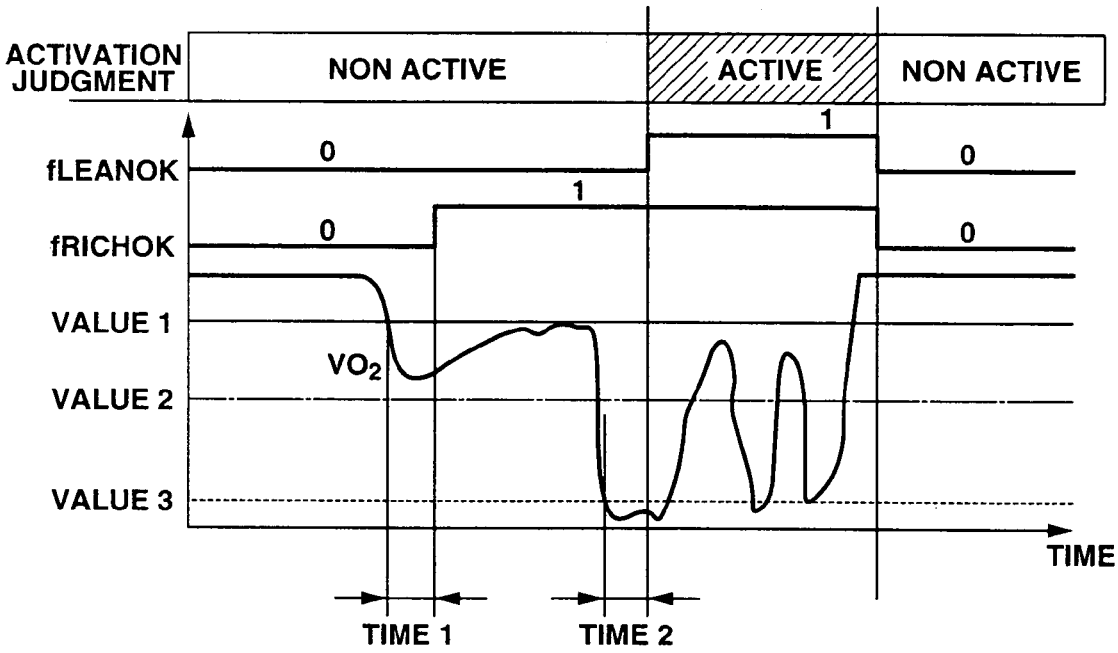
FIG. 19 is a graphic view showing time variation of the exhaust gas sensor output voltage for illustrating the activation judgment process of FIG. 18.

At S93, control unit 10 examines whether output voltage $VO_2$ of exhaust gas sensor 8 is greater than or equal to a second predetermined value (value 2). The second predetermined value (value 2) of the eighth practical example of FIG. 18 is smaller than the first predetermined value (value 1) as shown in FIG. 19. For example, the second predetermined value of the eight practical example is equal to 900 [mV]. When output voltage $VO_2$ is smaller than the second predetermined value, control unit 10 proceeds from S93 to a step S97. When output voltage $VO_2$ is greater than or equal to the second predetermined value, control unit 10 proceeds from S93 to a step S94.

At S94, control unit 10 increments (increases by one) an active output time counter CNT_RICHn for measuring a duration of an output within an active output range when exhaust gas sensor 8 is in the active state. After S94, control unit 10 proceeds to a step S95.

At S95, control unit 10 examines whether the time counter CNT_RICHn is greater than or equal to a predetermined first time (interval)(time 1). In this example, the predetermined first time is equal to 10 (corresponding to 100 ms). When time counter CNT_RICHn is smaller than the predetermined first time (time 1), control unit 10 proceeds from S25 to a step S101. When time counter CNT_RICHn is greater than or equal to the predetermined first time (time 1), control unit 10 proceeds from S95 to a step S96. At S96, control unit 10 sets the active output judgment flag fRICHOK to one. After S96, control unit 10 proceeds to S101.

At S97 reached from S93, control unit 10 examines whether output voltage $VO_2$ of exhaust gas sensor 8 is greater than or equal to a third predetermined value (value 3). The third predetermined value (value 3) of the eighth practical example of FIG. 18 is smaller than the second predetermined value (value 2) as shown in FIG. 19. For example, the third predetermined value of the eighth practical example is equal to 200 [mV]. When output voltage $VO_2$ is greater than or equal to the third predetermined value, control unit 10 proceeds from S97 to the step S101. When output voltage $VO_2$ is smaller than the third predetermined value, control unit 10 proceeds from S97 to a step S98.

At S98, control unit 10 increments (increases by one) a lean time counter CNT_LEANn for measuring a duration of a lean side output within a lean active output range when exhaust gas sensor 8 is in the active state. After S98, control unit 10 proceeds to a step S99.

At S99, control unit 10 examines whether the lean time counter CNT_LEANn is greater than or equal to a predetermined second time (time 2). In this example, the predetermined second time is equal to 10 (corresponding to 100 ms). When lean time counter CNT_LEANn is smaller than the predetermined second time (time 2), control unit 10 proceeds from S99 to S101. When lean time counter CNT_LEANn is greater than or equal to the predetermined second time (time 2), control unit 10 proceeds from S99 to a step S100. At S100, control unit 10 sets the lean output judgment flag fLEANOK to one. After S100, control unit 10 proceeds to a step S101.

At S101, control unit 10 examines whether the output judgment flag fRICHOK is equal to one or not. When output judgment flag fRICHOK is not equal to one, then control unit 10 terminates the process of FIG. 18. When output judgment flag fRICHOK is equal to one, then control unit 10 proceeds from S101 to a step S102.

At S102, control unit 10 examines whether the lean output judgment flag fLEANOK is equal to one or not. When lean output judgment flag fLEANOK is not equal to one, then control unit 10 terminates the process of FIG. 18. When lean output judgment flag fLEANOK is equal to one, then control unit 10 proceeds from S102 to a step S103.

At S103, control unit 10 sets the activation (judgment) flag fLIGHTOFF to one to indicate that exhaust gas sensor 8 is in the active state. After S103, control unit 10 terminates the process of FIG. 18.

As explained above, by the activation judgment process of FIG. 18, the control system checks the duration of the output in the range of the active state, and the duration of the lean side output in the range of the activation. Therefore, the control system can improve the reliability and accuracy of the sensor activation judgment.

Figure 20:
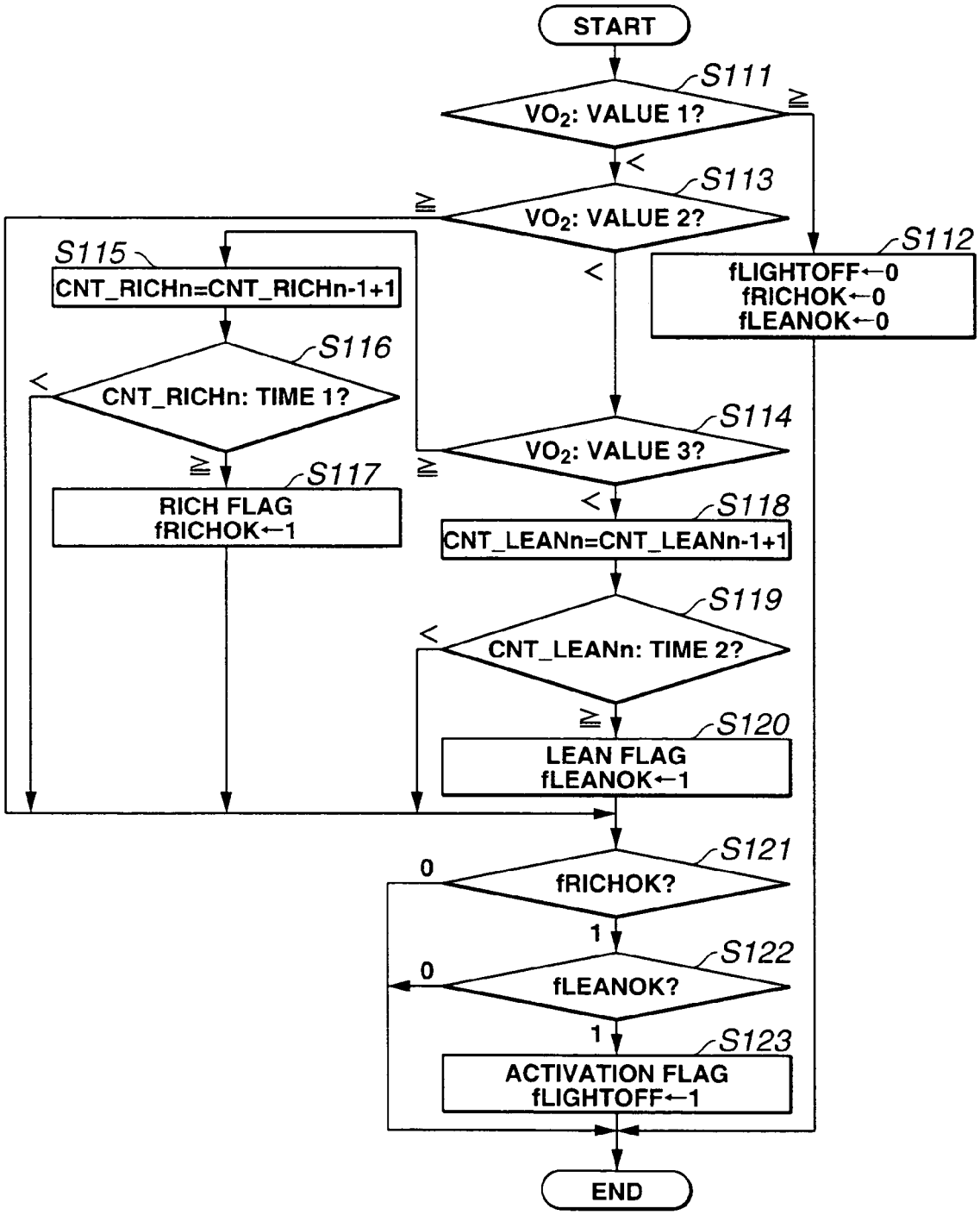
FIG. 20 is a flowchart showing an exhaust gas sensor activation judgment process in a ninth practical example of the embodiment shown in FIGS. 1 and 2.

FIG. 20 shows a ninth practical example of the activation judgment of S2 according to the present embodiment of the invention.

The activation judgment process shown in the flowchart of FIG. 20 is started after the control values are set by the operation of S1.

At S111 shown in FIG. 20, control unit 10 examines whether output voltage $VO_2$ of exhaust gas sensor 8 is greater than or equal to a first predetermined value (value 1). The first predetermined value of the eighth practical example is a value within the range of rich side output of exhaust gas sensor 8 in the active state. For example, the first predetermined value of the ninth practical example shown in FIG. 20 is equal to 1100 [mV]. When output voltage $VO_2$ is less than the first predetermined value, control unit 10 proceeds from S111 to a step S113. When output voltage $VO_2$ is greater than or equal to the first predetermined value, control unit 10 proceeds from S111 to a step S112.

At S112, control unit 10 resets each of activation flag (or activation judgment flag) fLIGHTOFF, active output judgment flag fRICHOK and lean output judgment flag fLEANOK to zero. The activation flag (or activation judgment flag) fLIGHTOFF is a condition code set to one to indicate that exhaust gas sensor 8 is activated, as in the first practical example. The active output judgment flag fRICHOK is a condition code which is set to one when the output voltage $VO_2$ of exhaust gas sensor 8 continues to be within an active output range for a time equal to or longer than a predetermined duration (a predetermined first time (interval), time 1); which is set to zero when the output voltage $VO_2$ of exhaust gas sensor 8 fails to continue to be within the rich side active range for a time equal to or longer than the predetermined duration (time 1); and which is reset to zero at the time of an engine start. The lean output judgment flag fLEANOK is a condition code which is set to one when the output voltage $VO_2$ of exhaust gas sensor 8 continues to be within a lean side active range for a time equal to or longer than a predetermined duration (a predetermined second time, time 2); which is set to zero when the output voltage $VO_2$ of exhaust gas sensor 8 fails to continue to be within the lean side active range for a time equal to or longer than the predetermined duration (time 2); and which is reset to zero at the time of an engine start. After S112, control unit 10 terminates the process of FIG. 20.

Figure 21:
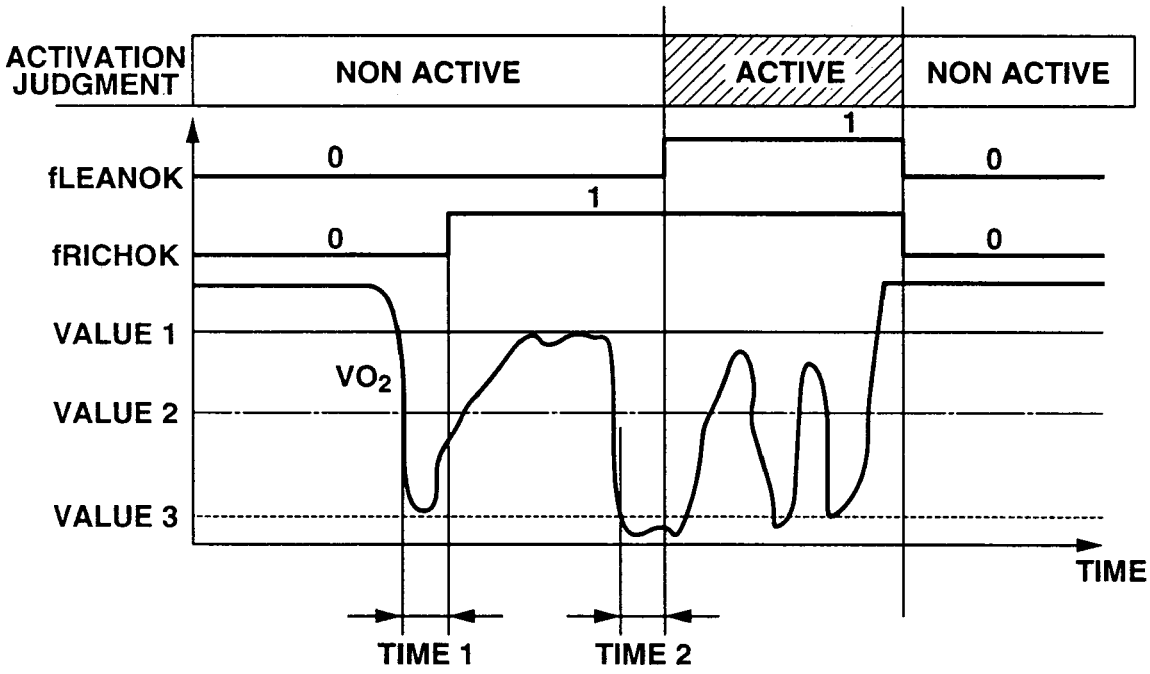
FIG. 21 is a graphic view showing time variation of the exhaust gas sensor output voltage for illustrating the activation judgment process of FIG. 20.

At S113, control unit 10 examines whether output voltage $VO_2$ of exhaust gas sensor 8 is greater than or equal to a second predetermined value (value 2). The second predetermined value (value 2) of the ninth practical example of FIG. 20 is smaller than the first predetermined value (value 1) as shown in FIG. 21. For example, the second predetermined value of the eight practical example is equal to 900 [mV]. When output voltage $VO_2$ is smaller than the second predetermined value, control unit 10 proceeds from S113 to a step S114. When output voltage $VO_2$ is greater than or equal to the second predetermined value, control unit 10 proceeds from S113 directly to a step S121.

At S114, control unit 10 examines whether output voltage $VO_2$ of exhaust gas sensor 8 is greater than or equal to a third predetermined value (value 3). The third predetermined value (value 3) of the ninth practical example of FIG. 20 is smaller than the second predetermined value (value 2) as shown in FIG. 21. For example, the third predetermined value of the ninth practical example is equal to 200 [mV]. When output voltage $VO_2$ is greater than or equal to the third predetermined value, control unit 10 proceeds from S114 to the step S115. When output voltage $VO_2$ is smaller than the third predetermined value, control unit 10 proceeds from S114 to a step S118.

At S115, control unit 10 increments (increases by one) an active time counter CNT_RICHn for measuring a duration of an active output within an active output range when exhaust gas sensor 8 is in the active state. After S115, control unit 10 proceeds to a step S116.

At S116, control unit 10 examines whether the active time counter CNT_RICHn is greater than or equal to a predetermined first time (interval)(time 1). In this example, the predetermined first time is equal to 10 (corresponding to 100 ms). When the active time counter CNT_RICHn is smaller than the predetermined first time (time 1), control unit 10 proceeds from S116 to a step S121. When the active time counter CNT_RICHn is greater than or equal to the predetermined first time (time 1), control unit 10 proceeds from S116 to a step S117. At S117, control unit 10 sets the active output judgment flag fRICHOK to one. After S117, control unit 10 proceeds to S121.

At S118, control unit 10 increments (increases by one) a lean time counter CNT_LEANn for measuring a duration of a lean side output within a lean active output range when exhaust gas sensor 8 is in the active state. After S118, control unit 10 proceeds to a step S119.

At S119, control unit 10 examines whether the lean time counter CNT_LEANn is greater than or equal to a predetermined second time (time 2). In this example, the predetermined second time is equal to 10 (corresponding to 100 ms). When lean time counter CNT_LEANn is smaller than the predetermined second time (time 2), control unit 10 proceeds from S119 to S121. When lean time counter CNT_LEANn is greater than or equal to the predetermined second time (time 2), control unit 10 proceeds from S119 to a step S120. At S120, control unit 10 sets the lean output judgment flag fLEANOK to one. After S120, control unit 10 proceeds to S121.

At S121, control unit 10 examines whether the active output judgment flag fRICHOK is equal to one or not. When the active output judgment flag fRICHOK is not equal to one, then control unit 10 terminates the process of FIG. 20. When the active output judgment flag fRICHOK is equal to one, then control unit 10 proceeds from S121 to S122.

At S122, control unit 10 examines whether the lean output judgment flag fLEANOK is equal to one or not. When lean output judgment flag fLEANOK is not equal to one, then control unit 10 terminates the process of FIG. 20. When leans output judgment flag fLEANOK is equal to one, then control unit 10 proceeds from S122 to S123.

At S123, control unit 10 sets the activation (judgment) flag fLIGHTOFF to one to indicate that exhaust gas sensor 8 is in the active state. After S123, control unit 10 terminates the process of FIG. 20.

United States Patent Application Publication No. US 2003/0213692 A1 shows an oxygen sensor which can be employed in the present invention. The explanation and figures about the oxygen sensor are hereby incorporated by reference.

This application is based on a prior Japanese Patent Application No. 2004-271866 filed in Japan on Sep. 17, 2004, and a second prior Japanese Patent Application No. 2005-240112 filed in Japan on Aug. 22, 2005. The entire contents of these Japanese Patent Applications Nos. 2004-271866 and 2005-240112 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. An air fuel ratio control system comprising:

an exhaust gas sensor disposed in an exhaust passage of an internal combustion engine and arranged to sense an oxygen concentration;

an actuator arranged to perform an air fuel ratio control in accordance with the oxygen concentration sensed by the exhaust gas sensor; and a controller configured to judge that the exhaust gas sensor is in an active state, by monitoring a decrease of an output of the exhaust gas sensor from a level greater than a first predetermined value, to a level smaller than or equal to the predetermined first predetermined value, and to allow the air fuel ratio control when the exhaust gas sensor is judged to be in the active statue;

wherein the controller is configured to judge the exhaust gas sensor to be in the active state when the output of the exhaust gas sensor continues to be smaller than or equal to the first predetermined value for a time longer than or equal to a predetermined time length.

2. The air fuel ratio control system as claimed in claim 1, wherein the exhaust gas sensor includes a standard electrode and a reference electrode between which a solid electrolyte is placed, and the exhaust gas sensor is arranged to apply a bias voltage between the standard electrode and the reference electrode and to sense the oxygen concentration in accordance with an electromotive force produced in dependence on a difference between an oxygen partial pressure of the standard electrode and an oxygen partial pressure of the reference electrode.

3. The air fuel ratio control system as claimed in claim 1, wherein the first predetermined value is a value within a rich output range of the output of the exhaust gas sensor when the exhaust gas sensor is in the active state on a rich side.

4. The air fuel ratio control system as claimed in claim 1, wherein the controller is configured to judge the exhaust gas sensor to be in the active state, by monitoring a time duration during which the output of the exhaust gas sensor stays between the first and second predetermined values.

5. An air fuel ratio control system, comprising:

an exhaust gas sensor disposed in an exhaust passage of an internal combustion engine and arranged to sense an oxygen concentration;

an actuator arranged to perform an air fuel ratio control in accordance with the oxygen concentration sensed by the exhaust gas sensor; and a controller configured to judge that the exhaust gas sensor is in an active state, by monitoring a decrease of an output of the exhaust gas sensor from a level greater than a first predetermined value, to a level smaller than or equal to the predetermined first predetermined value, and to allow the air fuel ratio control when the exhaust gas sensor is judged to be in the active state;

wherein the controller is configured to judge the exhaust gas sensor to be in the active state when the output of the exhaust gas sensor decreases from a level greater than a second predetermined value, to a level smaller than or equal to the second predetermined value which is smaller than the first predetermined value after the decrease of the output of the exhaust gas sensor under the first predetermined value;

wherein the second predetermined value is a value outside a lean output range of the output of the exhaust gas sensor when the exhaust gas sensor is in the active state on a lean side;

wherein the controller is configured to judge the exhaust gas sensor to be out of the active state when the output of the exhaust gas sensor is between the first and second predetermined values.

6. The air fuel ratio control system as claimed in claim 5, wherein the controller is configured to judge the exhaust gas sensor to be in the active state when the output of the exhaust gas sensor continues to be smaller than or equal to the second predetermined value for a time longer than or equal to a predetermined time length.

7. The air fuel ratio control system as claimed in claim 5, wherein the controller is configured to set the first and second predetermined values in accordance with an operating condition of the engine.

8. An air fuel ratio control system, comprising:

an exhaust gas sensor disposed in an exhaust passage of an internal combustion engine and arranged to sense an oxygen concentration;

an actuator arranged to perform an air fuel ratio control in accordance with the oxygen concentration sensed by the exhaust gas sensor; and a controller configured to judge that the exhaust gas sensor is in an active state, by monitoring a decrease of an output of the exhaust gas sensor from a level greater than a first predetermined value, to a level smaller than or equal to the predetermined first predetermined value, and to allow the air fuel ratio control when the exhaust gas sensor is judged to be in the active state;

wherein the controller is configured to compare the output of the exhaust gas sensor with a third predetermined value which is set outside a rich output range of the output of the exhaust gas sensor in the active state, and to judge the exhaust gas sensor to be in the active state when the output of the exhaust gas sensor becomes lower than or equal to the third predetermined value;

wherein the controller is configured to judge the exhaust gas sensor to be in the active state when the output of the exhaust gas sensor continues to be smaller than or equal to the third predetermined value for a time longer than or equal to a predetermined time length;

wherein the third predetermined value is a value within a lean output range of the output of the exhaust gas sensor when the exhaust gas sensor is in the active state on a lean side.

9. An air fuel ratio control process comprising:

performing an air fuel ratio control for an internal combustion engine in accordance with a sensed oxygen concentration of an exhaust of an internal combustion engine;

examining whether the exhaust gas sensor is in an active state or not, by monitoring a decrease of an output of the exhaust gas sensor from a level greater than a first predetermined value, to a level smaller than or equal to the first predetermined value; and allowing the air fuel ratio control when the exhaust gas sensor is judged to be in the active state;

wherein the exhaust gas sensor is judged to be in the active state when the output of the exhaust gas sensor continues to be smaller than or equal to the first predetermined value for a time longer than or equal to a predetermined time length.

10. An air fuel ratio control process, comprising:

performing an air fuel ratio control for an internal combustion engine in accordance with a sensed oxygen concentration of an exhaust of an internal combustion engine;

examining whether the exhaust gas sensor is in an active state or not, by monitoring a decrease of an output of the exhaust gas sensor from a level greater than a first predetermined value, to a level smaller than or equal to the first predetermined value; and allowing the air fuel ratio control when the exhaust gas sensor is judged to be in the active state;

wherein the exhaust gas sensor is judged to be in the active state when the output of the exhaust gas sensor decreases from a level greater than a second predetermined value, to a level smaller than or equal to the second predetermined value which is smaller than the first predetermined value after the decrease of the output of the exhaust gas sensor under the first predetermined value wherein the second predetermined value is a value outside a lean output range of the output of the exhaust gas sensor when the exhaust gas sensor is in the active state on a lean side;

wherein the controller is configured to judge the exhaust gas sensor to be out of the active state when the output of the exhaust gas sensor is between the first and second predetermined values.

11. An exhaust sensor activation judging apparatus for detecting an active state of an exhaust gas sensor disposed in an exhaust passage of an internal combustion engine, comprising:

a controller configured to monitor a decrease of an exhaust gas sensor output voltage below a bias voltage applied to the exhaust gas sensor, and to produce an active condition signal representing the active state of the exhaust gas sensor when the sensor output voltage is equal to or lower than a first voltage wherein the controller is configured to judge the exhaust gas sensor to be in the active state when the output of the exhaust gas sensor continues to be smaller than or equal to the first predetermined value for a time longer than or equal to a predetermined time length.

12. An exhaust sensor activation judging apparatus, for detecting an active state of an exhaust gas sensor disposed in an exhaust passage of an internal combustion engine, comprising:

a controller configured to monitor a decrease of an exhaust gas sensor output voltage below a bias voltage applied to the exhaust gas sensor, and to produce an active condition signal representing the active state of the exhaust gas sensor when the sensor output voltage is equal to or lower than a first voltage;

wherein the controller is configured to compare the sensor output voltage with the first voltage and a second voltage which is lower than the first voltage, and to produce the active condition signal when first and second conditions are met, the first condition being a condition which is met when the sensor output voltage is smaller than the first predetermined value, the second condition being a condition which is met when the sensor output voltage is lower than the second voltage wherein the second predetermined value is a value outside a lean output range of the output of the exhaust gas sensor when the exhaust gas sensor is in the active state on a lean side;

wherein the controller is configured to judge the exhaust gas sensor to be out of the active state when the output of the exhaust gas sensor is between the first and second predetermined values.

13. The exhaust sensor activation judging apparatus as claims in claim 11, wherein the controller is configured to terminate the active condition signal, and instead to produce an inactive condition signal when the sensor output voltage becomes higher than or equal to the first predetermined voltage.

14. An air fuel ratio control apparatus comprising:

means for performing an air fuel ratio control for an internal combustion engine in accordance with an oxygen concentration of an exhaust of an internal combustion engine sensed by an exhaust gas sensor;

means for examining whether the exhaust gas sensor is in an active state or not, by monitoring a decrease of an output of the exhaust gas sensor from a level greater than a first predetermined value, to a level smaller than or equal to the first predetermined value; and means for allowing the air fuel ratio control when the exhaust gas sensor is judged to be in the active state;

wherein the examining means includes means for judging the exhaust gas sensor to be in the active state when the output of the exhaust gas sensor continues to be smaller than or equal to the first predetermined value for a time longer than or equal to a predetermined time length.

* * * * *